US010639883B2

(12) United States Patent
Ozawa

(10) Patent No.: US 10,639,883 B2
(45) Date of Patent: May 5, 2020

(54) LIQUID EJECTING HEAD, LIQUID EJECTING APPARATUS, METHOD FOR CONTROLLING THE SAME

(71) Applicant: SEIKO EPSON CORPORATION, Tokyo (JP)

(72) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 16/012,636

(22) Filed: Jun. 19, 2018

(65) Prior Publication Data

US 2018/0370222 A1 Dec. 27, 2018

(30) Foreign Application Priority Data

Jun. 22, 2017 (JP) ..... 2017-121987

(51) Int. Cl.
*B41J 2/045* (2006.01)
*B41J 2/14* (2006.01)

(52) U.S. Cl.
CPC ..... *B41J 2/04508* (2013.01); *B41J 2/0458* (2013.01); *B41J 2/04581* (2013.01); *B41J 2/04588* (2013.01); *B41J 2/14233* (2013.01); *B41J 2002/14241* (2013.01); *B41J 2002/14419* (2013.01); *B41J 2202/16* (2013.01)

(58) Field of Classification Search
CPC .. B41J 2/04586; B41J 2/04508; B41J 2/0458; B41J 2/04581; B41J 2/04588; B41J 2/14233; B41J 2002/14241; B41J 2002/14419; B41J 2202/16
See application file for complete search history.

(56) References Cited

U.S. PATENT DOCUMENTS

| | | | | |
|---|---|---|---|---|
| 6,022,099 A | 2/2000 | Chwalek et al. | | |
| 6,050,676 A * | 4/2000 | Sugimoto | B41J 2/2107 | 347/100 |
| 6,412,928 B1 * | 7/2002 | Anagnostopoulos | B41J 2/03 | 347/77 |
| 8,172,369 B2 * | 5/2012 | Bergstedt | B41J 2/04515 | 347/60 |
| 8,740,365 B2 * | 6/2014 | Uezawa | B41J 2/14233 | 347/68 |

FOREIGN PATENT DOCUMENTS

| | | |
|---|---|---|
| JP | 10-202879 | 8/1998 |
| JP | 2002-500975 | 1/2002 |
| JP | 2008-221792 | 9/2008 |
| WO | 1999/37486 A | 7/1999 |

* cited by examiner

*Primary Examiner* — Thinh H Nguyen
(74) *Attorney, Agent, or Firm* — Workman Nydegger

(57) ABSTRACT

A liquid ejecting head includes: a nozzle that has a nozzle opening from which liquid is ejected; a pressure compartment that is in communication with the nozzle; a drive element configured to vary pressure of the liquid inside the pressure compartment for ejecting the liquid from the nozzle opening; and a control element configured to apply energy to the liquid in a flow passage from the pressure compartment to the nozzle opening.

16 Claims, 11 Drawing Sheets

LIQUID EJECTING HEAD, LIQUID EJECTING APPARATUS, METHOD FOR CONTROLLING THE SAME

BACKGROUND

1. Technical Field

The present invention relates to a liquid ejecting head, a liquid ejecting apparatus, a method for controlling a liquid ejecting head, and a method for controlling a liquid ejecting apparatus.

2. Related Art

A liquid ejecting apparatus is a device provided with a liquid ejecting head and configured to eject (discharge) various kinds of liquid from nozzles of the head. An image recording apparatus such as an ink-jet printer or an ink-jet plotter is known as an example of a liquid ejecting apparatus. Recently, liquid ejecting apparatuses have been applied to various manufacturing apparatuses while taking advantage of their capability of ejecting a very small amount of liquid onto a predetermined position accurately. Some examples of the applications are: a display manufacturing apparatus for manufacturing a color filter for a liquid crystal display, etc.; an electrode forming apparatus for forming electrodes of an organic EL (electroluminescence) display or an FED (surface emission display), etc.; and a chip manufacturing apparatus for producing biochips (biochemical element). A recording head used for image recording ejects ink, in the form of liquid droplets, from nozzles. A color material ejecting head used for manufacturing displays ejects a solution of R (red), G (green), and B (blue) colorants from nozzles. An electrode material ejecting head used for forming electrodes ejects a liquid electrode material from nozzles. A living organic material ejecting head used for chip production ejects a solution of a living organic material from nozzles.

Since there are individual differences in a liquid ejecting head mounted on a liquid ejecting apparatus, in a case where liquid ejection control is performed under the same drive conditions (for example, using the same drive signal) without any individual consideration, ejection characteristics such as the amount of liquid (liquid droplet) ejected from nozzles, and the speed of droplet movement in the air, etc. vary from one to another. Because of variations in ejection characteristics, in some cases, a problem such unevenness in density occurs in an output that is the result of liquid ejecting operation (for example, an image printed on a recording medium). In particular, in a so-called line-type liquid ejecting head that includes an array of head units having nozzle groups made up of nozzles arranged in rows, ejection characteristics vary from head unit to head unit because of individual differences among the head units, because of differences in liquid supply path length from the liquid supply source to the respective head units, and the like. In an attempt to solve this problem, for example, in an invention disclosed in JP-A-2008-221792, the waveform of a drive signal is varied from head unit to head unit in accordance with supply path length, etc.

The waveform of a drive signal taken as a basis is usually designed such that a predetermined amount (weight, volume) of a liquid droplet will be ejected from a nozzle when a drive element such as a piezoelectric element is driven by means of the drive signal and such that the generation of a finer droplet accompanying the ejection of the liquid droplet, more specifically, a satellite droplet or "finer-than-satellite" mist, will be suppressed. However, in a case where the waveform of a drive signal taken as a basis is corrected, for example, in a case where correction is made for increasing a voltage so as to adjust the amount of a liquid droplet into a target amount, a resultant increase in the in-the-air speed of a liquid droplet ejected from a nozzle makes it more likely that the above-mentioned satellite droplet, etc. will be generated and, therefore, there is a risk that the shape of a dot formed as a result of droplet landing onto the target might also change. That is, there is a problem in the art that it is difficult to make exact adjustment of ejection characteristics by correcting a drive signal.

SUMMARY

An advantage of some aspects of the invention is to provide a liquid ejecting head, a liquid ejecting apparatus, a method for controlling a liquid ejecting head, and a method for controlling a liquid ejecting apparatus that makes it possible to adjust liquid droplet ejection characteristics while suppressing the generation of a satellite droplet, etc.

A liquid ejecting head according to an aspect of the invention includes: a nozzle that has a nozzle opening from which liquid is ejected; a pressure compartment that is in communication with the nozzle; a drive element that varies pressure of the liquid inside the pressure compartment for ejecting the liquid from the nozzle opening; and a control element that applies energy to the liquid in a flow passage from the pressure compartment to the nozzle opening; wherein, by applying the energy to the liquid in the flow passage, the control element makes surface tension of a part of the liquid forced out from the nozzle opening by driving the drive element different from surface tension of other part of the liquid.

The application of the energy to the ink in the flow passage makes the surface tension of the part of the liquid (liquid pillar) forced out from the nozzle opening by driving the drive element different from the surface tension of the other part of the liquid, thereby making it easier for the liquid to be split at the part. By controlling the applying of the energy to the liquid by the control element, it is possible to adjust ejection characteristics of the liquid (liquid droplet) ejected from the nozzle opening. Therefore, it is possible to reduce variations in ejection characteristics due to individual differences in the liquid ejecting head, etc. more effectively. Moreover, since the liquid pillar forced out from the nozzle opening is not excessively stretched, a so-called tail-forming phenomenon, which is a phenomenon of forming a tail of a liquid droplet ejected from a nozzle opening, is suppressed. Consequently, the generation of a finer droplet accompanying the ejection of the liquid droplet, more specifically, a satellite droplet or "finer-than-satellite" mist, is reduced.

In the above structure, preferably, the control element should be provided at periphery of the nozzle.

In the above structure, since the control element is provided at periphery of the nozzle, the timing difference between the point in time of applying energy to the liquid by the control element and the point in time of ejecting a liquid droplet from the nozzle opening (the point in time of release of the liquid pillar forced out from the nozzle opening from the meniscus inside the nozzle) is reduced. Therefore, dispersion of the energy applied to the liquid inside the liquid during the process is suppressed, and a resultant decrease in the energy is also suppressed. Therefore, it is possible to adjust ejection characteristics with high precision.

In the above structure, the control element may be provided at predetermined intervals non-continuously along the periphery of the nozzle opening, with exposure to the nozzle opening.

Since the above structure further reduces the timing difference between the point in time of applying energy to the liquid by the control element and the point in time of ejecting a liquid droplet from the nozzle opening, the precision in adjustment of ejection characteristics further improves. Furthermore, since the control element is provided at predetermined intervals non-continuously along the periphery of the nozzle opening, that is, since the control element is arranged in a balanced manner around the nozzle opening, it is possible to apply energy to liquid without an imbalance in the circumferential direction of the nozzle opening. Therefore, it is possible to prevent a liquid droplet ejected from the nozzle opening from deviating from the target direction in the air.

In the above structure, preferably, the liquid should contain a composite that has surface activity.

The surface activity of the composite contained in the liquid, in addition to the application of the energy to the liquid by the control element, makes it possible to more actively change the surface tension of the part of the liquid pillar. This makes it easier for the liquid pillar to be split at the part. Consequently, the adjustment of ejection characteristics becomes easier. Furthermore, it is possible to suppress a satellite droplet, etc. more reliably.

In the above structure, preferably, the head should further include: a plurality of head units each of which includes the nozzle, the pressure compartment, the drive element, and the control element.

This structure makes it possible to reduce variations in ejection characteristics due to individual differences among the head units more effectively.

In the above structure, the control element may be a heat generation element that applies thermal energy to the liquid in the flow passage from the pressure compartment to the nozzle opening or a vibration element that applies vibration energy to the liquid in the flow passage from the pressure compartment to the nozzle opening.

A liquid ejecting apparatus according to an aspect of the invention includes: a nozzle that has a nozzle opening from which liquid is ejected; a pressure compartment that is in communication with the nozzle; a drive element that varies pressure of the liquid inside the pressure compartment for ejecting the liquid from the nozzle opening; and a control element that applies energy to the liquid in a flow passage from the pressure compartment to the nozzle opening; wherein, by applying the energy to the liquid in the flow passage, the control element makes surface tension of a part of the liquid forced out from the nozzle opening by driving the drive element different from surface tension of other part of the liquid.

The application of the energy to the ink in the flow passage makes the surface tension of the part of the liquid (liquid pillar) forced out from the nozzle opening by driving the drive element different from the surface tension of the other part of the liquid, thereby making it easier for the liquid to be split at the part. By controlling the applying of the energy to the liquid by the control element, it is possible to adjust ejection characteristics of the liquid (liquid droplet) ejected from the nozzle opening. Therefore, it is possible to reduce variations in ejection characteristics more effectively. Moreover, since the liquid pillar forced out from the nozzle opening is not excessively stretched, a so-called tail-forming phenomenon, which is a phenomenon of forming a tail of a liquid droplet ejected from a nozzle opening, is suppressed. Consequently, the generation of a finer droplet accompanying the ejection of the liquid droplet, more specifically, a satellite droplet or "finer-than-satellite" mist, is reduced.

In the above structure, preferably, the control element should be provided at periphery of the nozzle.

In the above structure, since the control element is provided at periphery of the nozzle, the timing difference between the point in time of applying energy to the liquid by the control element and the point in time of ejecting a liquid droplet from the nozzle opening (the point in time of release of the liquid pillar forced out from the nozzle opening from the meniscus inside the nozzle) is reduced. Therefore, dispersion of the energy applied to the liquid inside the liquid during the process is suppressed, and a resultant decrease in the energy is also suppressed. Therefore, it is possible to adjust ejection characteristics with high precision.

In the above structure, the control element may be provided at predetermined intervals non-continuously along the periphery of the nozzle opening, with exposure to the nozzle opening.

Since the above structure further reduces the timing difference between the point in time of applying energy to the liquid by the control element and the point in time of ejecting a liquid droplet from the nozzle opening, the precision in adjustment of ejection characteristics further improves. Furthermore, since the control element is provided at predetermined intervals non-continuously along the periphery of the nozzle opening, that is, since the control element is arranged in a balanced manner around the nozzle opening, it is possible to apply energy to liquid without an imbalance in the circumferential direction of the nozzle opening. Therefore, it is possible to prevent a liquid droplet ejected from the nozzle opening from deviating from the target direction in the air.

In the above structure, preferably, the liquid should contain a composite that has surface activity.

The surface activity of the composite contained in the liquid, in addition to the application of the energy to the liquid by the control element, makes it possible to more actively change the surface tension of the part of the liquid pillar. This makes it easier for the liquid pillar to be split at the part. Consequently, the adjustment of ejection characteristics becomes easier. Furthermore, it is possible to suppress a satellite droplet, etc. more reliably.

In the above structure, preferably, the apparatus should further include: a signal generation circuit that generates a drive pulse for driving the drive element and a control pulse regarding control of the control element; wherein the control pulse is generated within a period from after a timing signal defining generation timing of the drive pulse to an end of the drive pulse.

In the above structure, since the control pulse is generated correspondingly to the timing of generating the drive pulse for liquid ejecting operation, the applying of the energy to the liquid by the control element in link with the ejecting operation based on the drive pulse is performed at more appropriate timing.

In the above structure, the control element may be a heat generation element that applies thermal energy to the liquid in the flow passage from the pressure compartment to the nozzle opening or a vibration element that applies vibration energy to the liquid in the flow passage from the pressure compartment to the nozzle opening.

Another aspect of the invention is: a method for controlling a liquid ejecting head that includes a nozzle that has a nozzle opening from which liquid is ejected, a pressure compartment that is in communication with the nozzle, a drive element that varies pressure of the liquid inside the pressure compartment for ejecting the liquid from the nozzle opening; and a control element that applies energy to the liquid in a flow passage from the pressure compartment to the nozzle opening, comprising: applying the energy to the liquid in the flow passage by the control element, in ejecting the liquid from the nozzle opening by driving the drive element; wherein, in the applying the energy, surface tension of a part of the liquid forced out from the nozzle opening in the ejecting is made different from surface tension of other part of the liquid.

Another aspect of the invention is: a method for controlling a liquid ejecting apparatus that includes a nozzle that has a nozzle opening from which liquid is ejected, a pressure compartment that is in communication with the nozzle, a drive element that varies pressure of the liquid inside the pressure compartment for ejecting the liquid from the nozzle opening; and a control element that applies energy to the liquid in a flow passage from the pressure compartment to the nozzle opening, comprising: applying the energy to the liquid in the flow passage by the control element, in ejecting the liquid from the nozzle opening by driving the drive element; wherein, in the applying the energy, surface tension of a part of the liquid forced out from the nozzle opening in the ejecting is made different from surface tension of other part of the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
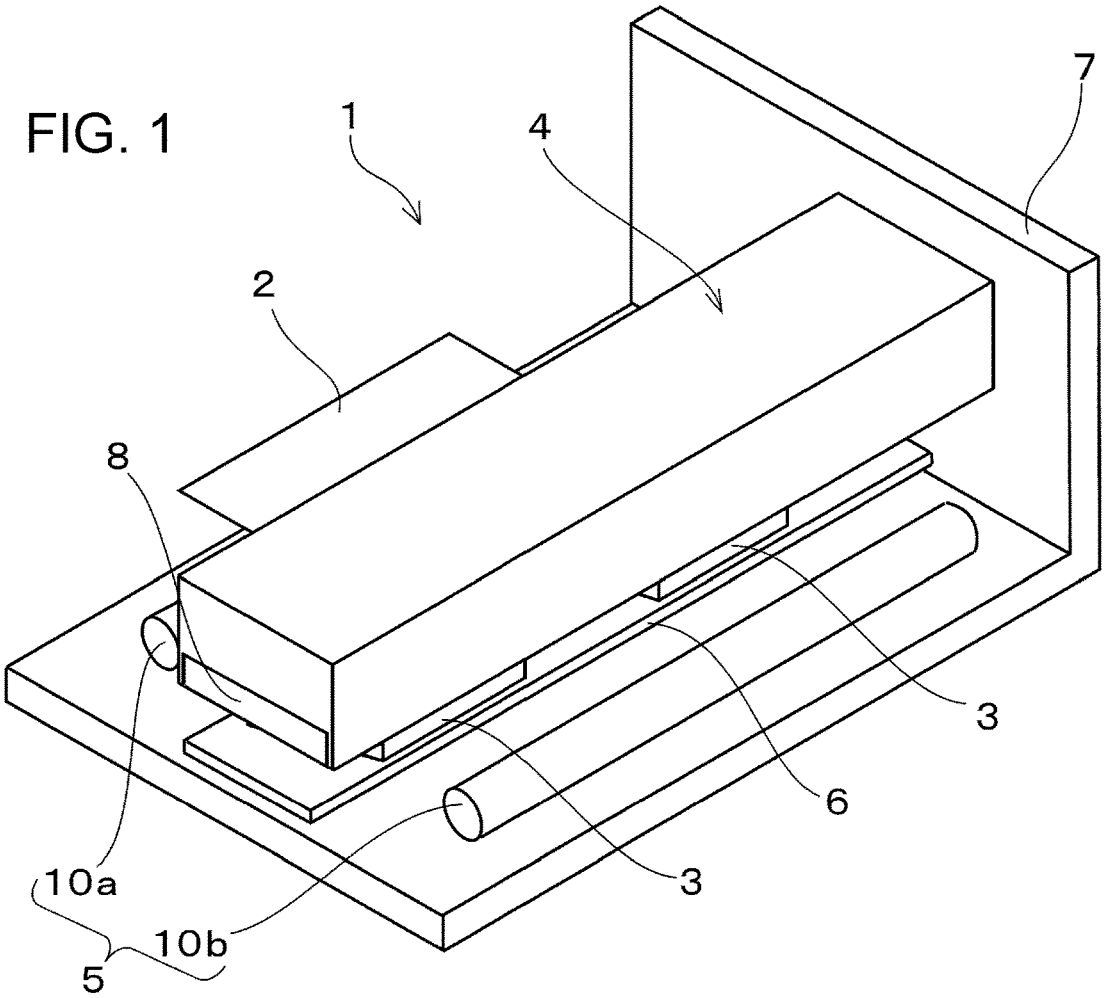
FIG. 1 is a perspective view for explaining the structure of a liquid ejecting apparatus (printer).

With reference to the accompanying drawings, exemplary embodiments of the present invention will now be explained. Various specific features are explained in the following embodiments of the invention for the purpose of disclosing preferred modes thereof. However, the scope of the invention is not limited to the specific embodiments described below unless any intention of restriction is explicitly shown. In the following description, an ink-jet recording apparatus (hereinafter referred to as "printer") is taken as an example of a liquid ejecting apparatus according to some aspects of the invention.

First, the structure of a printer 1 will now be explained. A printer 1 according to a first embodiment is a device that forms dots by ejecting liquid ink onto the surface of a recording medium 2 (a kind of the target of droplet landing), for example, paper, and prints (records) an image, etc. by means of a dot pattern, or more specifically, a so-called line printer that performs print operation (liquid ejecting operation) while transporting the recording medium 2 without scanning a recording head 4. The printer 1 of the present embodiment includes, inside its body 7, a recording head 4 (which corresponds to a liquid ejecting head according to some aspects of the invention) including a plurality of head blocks 3 mounted on a holder 8, a transporting mechanism 5 configured to transport the recording medium 2, and a medium support 6 for supporting the recording medium 2 in a state of facing the bottom surface (nozzle surface) of each head block of the recording head 4. In the description below, the width direction of the recording medium 2 (the direction of the long sides of the rectangular recording head 4) is referred to as the first direction, the transportation direction of the recording medium 2 is referred to as the second direction, and the direction perpendicular to the supporting surface of the medium support 6 is referred to as the third direction.

The recording head 4 of the present embodiment is fixed to the printer body 7 in such a manner that the nozzle surface of each of the head blocks 3 is oriented toward the medium support 6 (platen), wherein the head blocks 3 are mounted on the holder 8 in an array direction (first direction) intersecting with the transportation direction of the recording medium 2 (second direction). Ink is supplied to each of the head blocks 3 from an ink cartridge that is not illustrated and contains the ink. Ink is a kind of liquid according to some aspects of the invention. The ink cartridge may be mounted on the recording head 4. Alternatively, the ink cartridge may be provided at a position different from the position of the recording head 4 in the printer body 7, and ink may be supplied to each of the head blocks 3 through a supply tube, etc.

The transporting mechanism 5 includes a first transportation roller pair 10*a*, which is made up of upper and lower rollers provided upstream of the medium support 6 in the transportation direction of the recording medium 2, and a second transportation roller pair 10*b*, which is made up of upper and lower rollers provided downstream of the medium support 6 in the transportation direction of the recording medium 2. By driving the transportation rollers 10*a* and 10*b*, the transporting mechanism 5 transports the recording medium 2 fed from the feeding side over and across the medium support 6 toward the ejection side.

The medium support 6 of the present embodiment is a rectangular supporting plate that has its long sides in the array direction of the head blocks 3 and supports the recording medium 2, which is the target of printing an image, etc. by the recording head 4. The transporting mechanism 5 may be an endless belt or a drum. In such a structure, the belt or the drum functions as the medium support. For the medium support 6, a structure of holding the recording medium 2 by using an electrostatic force or a structure of sucking the recording medium 2 by generating negative pressure may be adopted.

Figure 2:
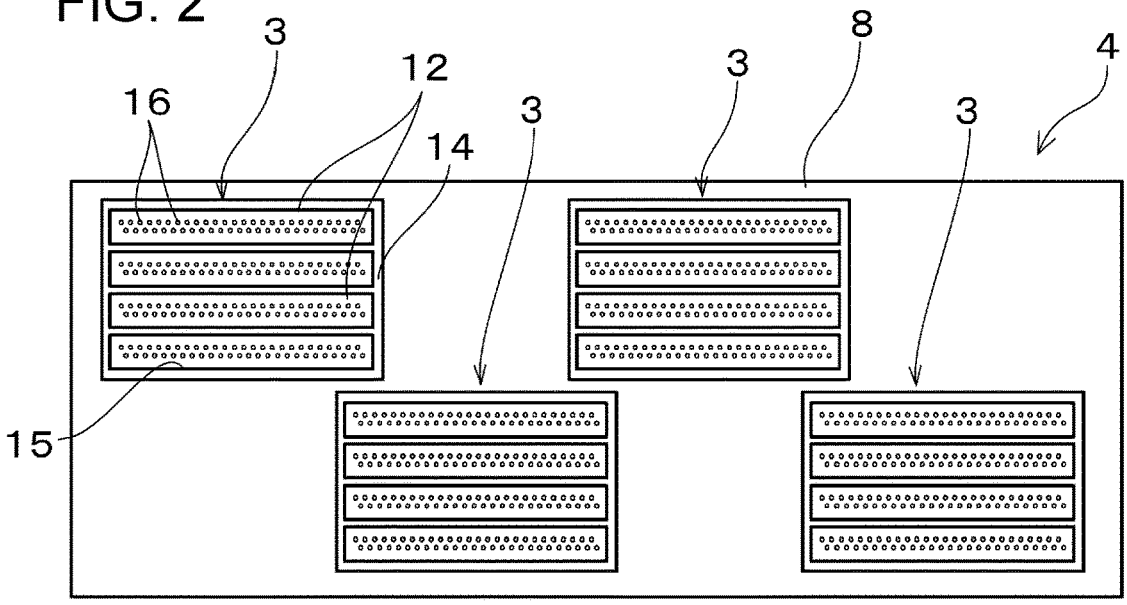
FIG. 2 is a bottom view of a liquid ejecting head (recording head).

FIG. 2 is a bottom view of the recording head 4. The plural head blocks 3 (four blocks in the present embodiment) are held on the lower surface of the holder 8 of the recording head 4, that is, on the surface facing the medium support 6, along the first direction in a staggered array such that their positions in the second direction differ alternately. Each head block 3 includes a plurality of head units 12 (head chip) and a fixing plate 14 for protection of the head units 12. As will be described later, the head unit 12 has a stack structure that includes, as its constituents, a nozzle plate 17 in which plural nozzles 16 are provided next to one another in rows, a substrate in which ink flow passages are formed in communication with the nozzles 16, an actuator unit that is a driver for ink ejection, and the like.

The fixing plate 14 is a plate member that is made of metal and is common to the head units 12 of the head block 3. The fixing plate 14 is manufactured by press working. At a position corresponding to the nozzle plate 17 of each head unit 12, the fixing plate 14 has an opening 15 elongated in the nozzle-row direction for exposing the nozzles 16 (nozzle rows) formed in the nozzle plate 17. Each head unit 12 is bonded to the upper surface of the fixing plate 14 (the opposite of the surface facing the medium support 6) by means of an adhesive, etc. in a state in which the nozzles 16 are exposed through the opening 15 corresponding thereto. Bonding the nozzle plate 17 to the fixing plate 14 determines the level of each head unit 12, that is, the position in the direction perpendicular to the nozzle plate 17. In the present embodiment, the lower surface of the fixing plate 14 (the surface facing the medium support 6) and the exposed regions of the nozzle plates 17 at the openings 15 constitute the nozzle surface, which is the bottom surface of the head block 3.

Figure 3:
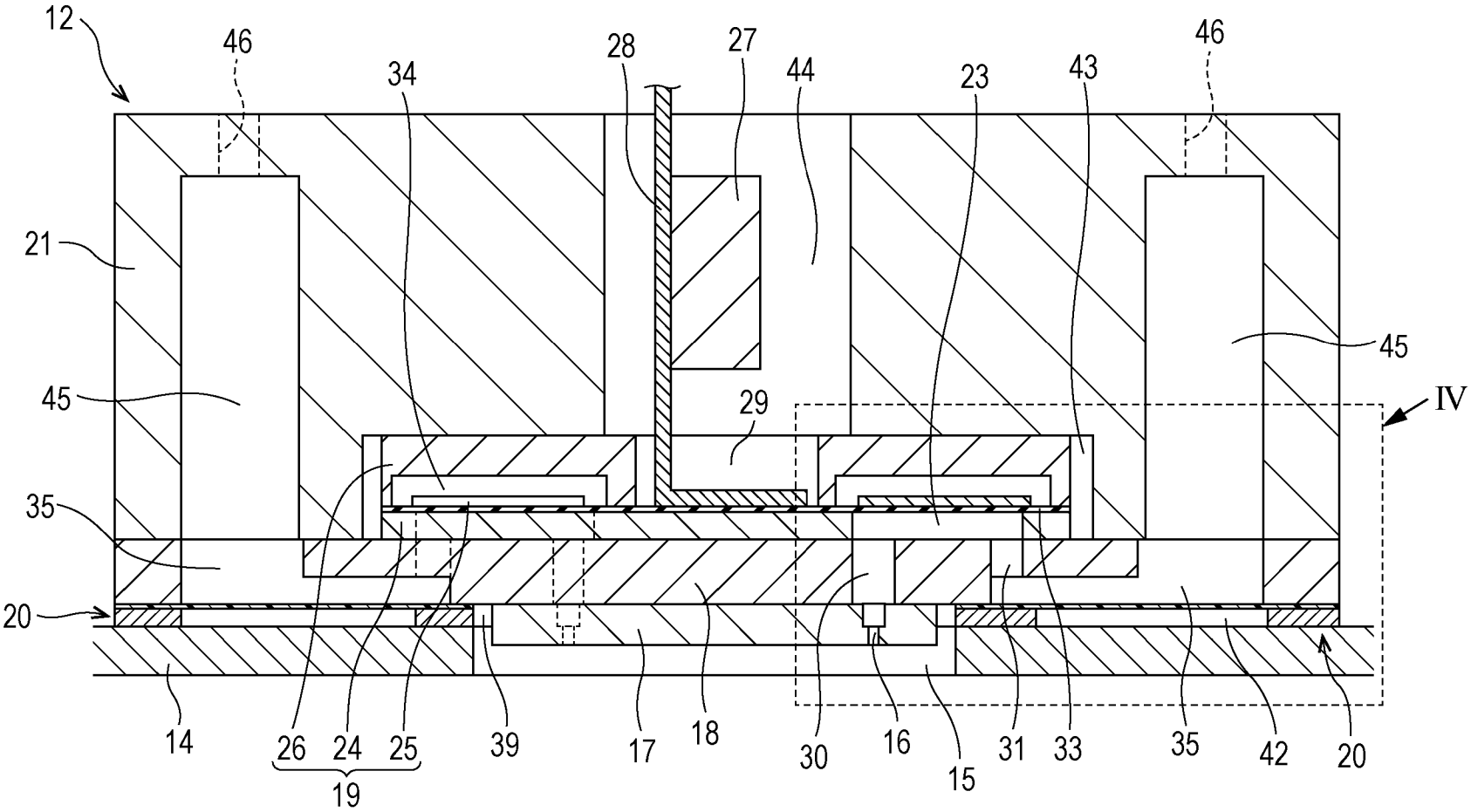
FIG. 3 is a cross-sectional view for explaining the structure of a head unit.
Figure 4:
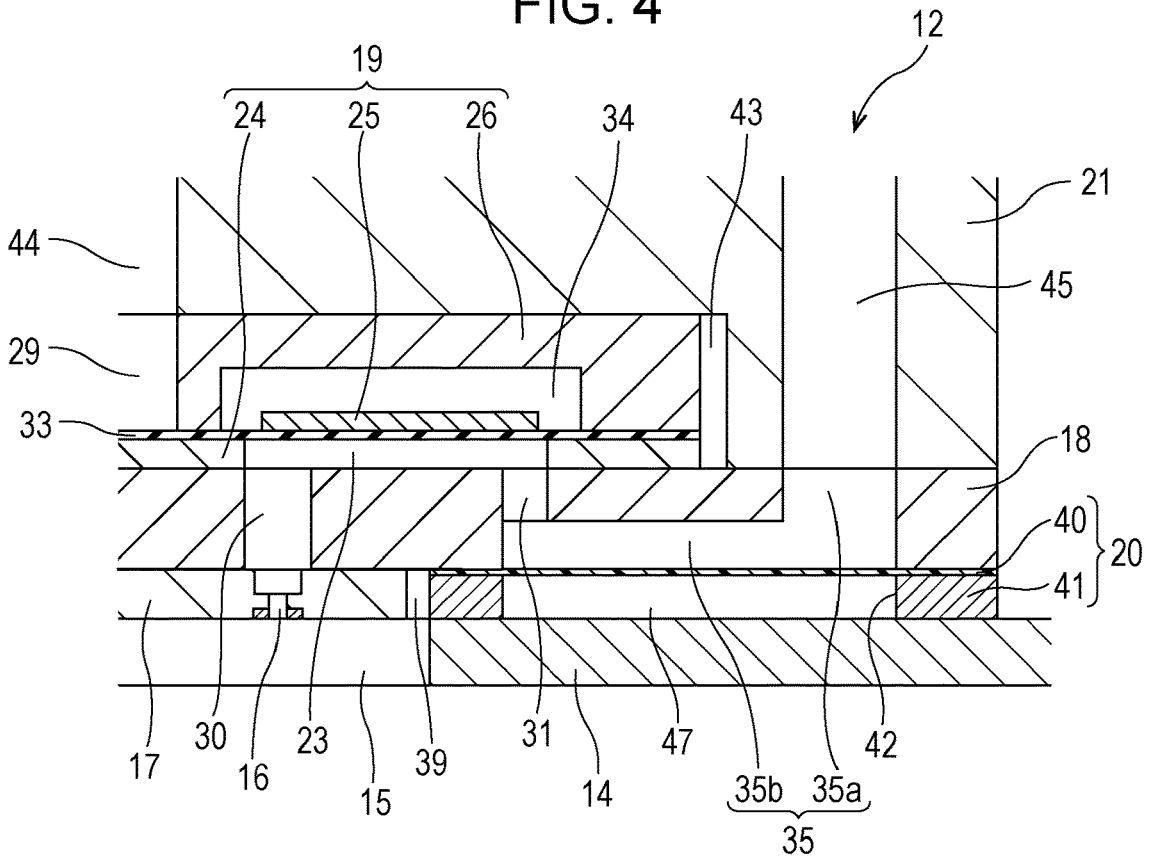
FIG. 4 is an enlarged view of an area IV illustrated in FIG. 3.

FIG. 3 is a cross-sectional view for explaining the structure of the head unit 12, taken in a direction perpendicular to nozzle rows. FIG. 4 is an enlarged view of an area IV illustrated in FIG. 3. Although the structure of only one of the plurality of head units 12 is illustrated in FIG. 4, the structure of other head units is the same as the illustrated structure. To constitute the head unit 12 of the present embodiment, plural members such as the nozzle plate 17, a communication plate 18, an actuator substrate 19, a compliance substrate 20, and a case 21, etc. are stacked and bonded together for unitization by means of an adhesive, etc.

The actuator substrate 19 of the present embodiment includes, in a stacked state, a pressure compartment forming substrate 24, in which pressure compartments 23 are formed in communication with the respective nozzles 16 provided in the nozzle plate 17, piezoelectric elements 25 functioning as an example of a drive element for causing pressure vibration in ink inside the respective pressure compartments 23, and a protection substrate 26 for protecting the pressure compartment forming substrate 24 and the piezoelectric elements 25. The protection substrate 26 has a wiring space 29 substantially at its center in plan view. A flexible substrate 28, on which a driver IC 27 is mounted, is inserted through the wiring space 29. Lead electrodes of the piezoelectric elements 25 are arranged inside the region of the wiring space 29. Wiring terminals of the flexible substrate 28 are electrically connected to the lead electrodes. A drive signal sent from a signal generation circuit 53, which will be described later, is supplied to the piezoelectric elements 25 through the flexible substrate 28. In addition, a control signal regarding ON/OFF control of heat generation elements 37, which will be described later, is sent from the signal generation circuit 53. Control for selective application of a drive pulse Pd (see FIG. 8) included in the drive signal to the piezoelectric elements 25 and control for turning the heat generation elements 37 ON/OFF in accordance with the control signal are performed by the driver IC 27 (a detailed explanation will be given later). The position where the driver IC 27 is mounted is not limited to on the flexible substrate 28; the driver IC 27 may be provided separately over the protection substrate 26, with a so-called interposer provided therebetween.

The pressure compartment forming substrate 24 is made of, for example, a silicon single crystal substrate. A plurality of spaces serving as the pressure compartments 23 and corresponding to the plurality of nozzles 16 is formed in the pressure compartment forming substrate 24. The pressure compartment 23 is a space that is elongated in a direction intersecting with (in the present embodiment, perpendicular to) the nozzle row. A nozzle communication opening 30 is formed in communication with one end in the elongation direction of the pressure compartment 23. Similarly, an individual communication opening 31 is formed in communication with the other end in the elongation direction of the pressure compartment 23. Two rows of the pressure compartments 23 are formed in the pressure compartment forming substrate 24 of the present embodiment.

A vibration plate 33 is formed on the upper surface of the pressure compartment forming substrate 24 (that is, the opposite of the surface that is on the communication plate 18). The opening at the top of the pressure compartments 23 is hermetically closed by the vibration plate 33. That is, a part of each pressure compartment 23 is demarcated by the vibration plate 33. The vibration plate 33 is made up of, for example, an elastic film and an insulation film, wherein the elastic film is made of silicon dioxide ($SiO_2$) and is formed on the upper surface of the pressure compartment forming substrate 24, and wherein the insulation film is made of zirconium oxide ($ZrO_2$) and is formed on the upper surface of the elastic film. The piezoelectric elements 25 are provided on the vibration plate 33 respectively at areas corresponding to the pressure compartments 23.

The piezoelectric element 25 of the present embodiment is a so-called flexural-mode piezoelectric element. The piezoelectric element 25 has a layered structure produced by sequentially forming, on the vibration plate 33, for example, a lower electrode layer, a piezoelectric layer, and an upper electrode layer (none of which is illustrated). Flexural deformation, in the vertical direction, of the piezoelectric element 25 having such a structure occurs when an electric field corresponding to a potential difference between the lower electrode layer and the upper electrode layer is applied therebetween. In the present embodiment, two rows of the piezoelectric elements 25 corresponding to the two rows of the pressure compartments 23 are formed. The lower electrode layer and the upper electrode layer extend as the lead electrodes from the two rows of the piezoelectric elements 25 into the region of the wiring space 29 between the two rows and are electrically connected to the flexible substrate 28 described above.

The protection substrate 26 is stacked on the vibration plate 33 in such a way as to cover the two rows of the piezoelectric elements 25. For accommodation of these rows of the piezoelectric elements 25, the protection substrate 26 has accommodation spaces 34 inside. The accommodation space 34 is a cavity formed from the lower surface of the protection substrate 26 (from its bottom over the vibration plate 33) toward the upper surface of the protection substrate 26 (toward the case 21) halfway in the height direction of the protection substrate 26. The protection substrate 26 of the present embodiment has the accommodation spaces 34 on respective two sides adjacently to the wiring space 29. The communication plate 18, which has a wider area than the actuator substrate 19, is bonded to the lower surface of the actuator substrate 19.

Similarly to the pressure compartment forming substrate 24, the communication plate 18 is made of a silicon single crystal substrate. The nozzle communication openings 30, which are for communication between the pressure compartments 23 and the nozzles 16, a reservoir(s) 35 (a kind of common liquid room; called also as manifold), which is shared by the pressure compartments 23, and the individual communication openings 31, which are for communication between the reservoir 35 and the pressure compartments 23, are formed in the communication plate 18 of the present embodiment by, for example, anisotropic etching. The reservoir 35 is a space that extends in the nozzle-row direction. In the communication plate 18 of the present embodiment, two reservoirs corresponding respectively to the two nozzle rows of the nozzle plate 17 are formed. Alternatively, a plurality of reservoirs may be provided for each one nozzle row, and different kinds of ink may be assigned to the plurality of reservoirs respectively. The nozzle communication openings 30, the individual communication opening 31, and the reservoir 35 are formed from the lower surface of the communication plate 18 by anisotropic etching. Ink supplied through an inlet 46 of each liquid room space 45 formed in the case 21 flows into the reservoir 35 as will be described later. The plurality of individual communication openings 31 is formed in array in the nozzle-row direction correspondingly to the respective pressure compartments 23. The individual communication opening 31 is formed in communication with the other end in the elongation direction of the pressure compartment 23 (the opposite of the end that is in communication with the nozzle communication opening 30).

As illustrated in FIG. 4, the reservoir 35 is made up of a first reservoir portion 35*a* and a second reservoir portion 35*b*. The first reservoir portion 35*a* is a through-hole space that is formed through the communication plate 18 in the plate-thickness direction and has an opening shape conforming to, and opening size matching with, the shape and size of the bottom opening of the liquid room space 45 of the case 21. The first reservoir portion 35*a* is in communication with the liquid room space 45 of the case 21. The second reservoir portion 35*b* is a cavity formed from the lower surface of the communication plate 18 (from its bottom over the compliance substrate 20) halfway up in the plate-thickness direction while leaving a "made-thinner" portion toward the upper surface of the communication plate 18. The second reservoir portion 35*b* extends from one end to the other end of the first reservoir portion 35*a* in the nozzle-row direction and is in communication with the first reservoir portion 35*a*. The above-mentioned made-thinner portion over the second reservoir portion 35*b* has the array of the individual communication openings 31 in the nozzle-row direction (first direction) correspondingly to the pressure compartments 23 in communication with the pressure compartments 23 respectively. That is, via these individual communication openings 31, the reservoir 35 is individually in communication with the respective pressure compartments 23. The opening at the bottom of the reservoir 35 is hermetically closed by a compliance sheet 40 of the compliance substrate 20.

Figure 5:
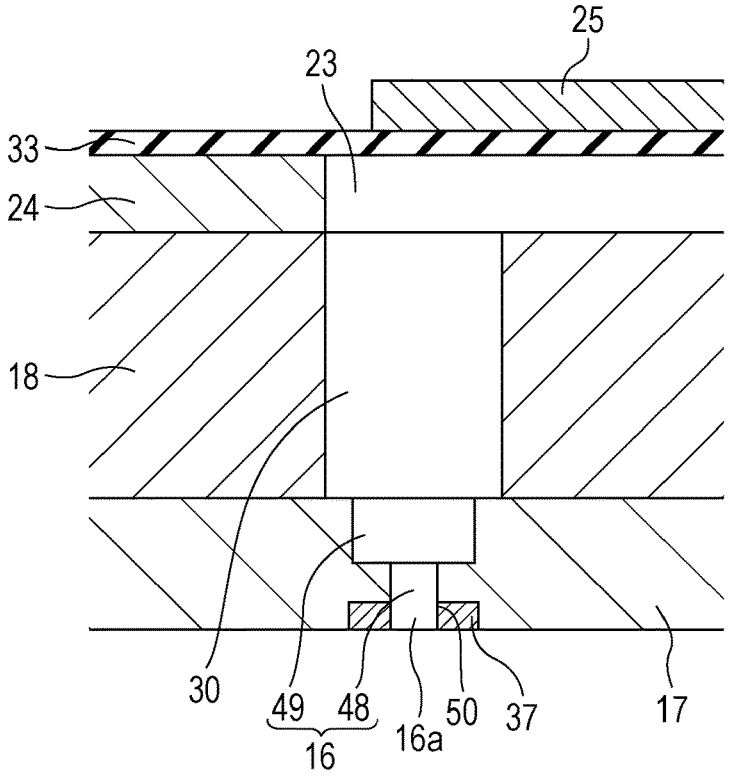
FIG. 5 is a cross-sectional view for explaining the structure of a flow passage from a pressure compartment to a nozzle orifice.

Referring back to FIG. 3, the nozzle plate 17, in which the plurality of nozzles 16 is formed, is bonded to substantially the center region of the lower surface of the communication plate 18 described above. The nozzle plate 17 of the present embodiment is a plate member that is smaller in contour shape than the communication plate 18 and the actuator substrate 19 and is made of a silicon single crystal substrate. The nozzle plate 17 is bonded to the lower surface of the communication plate 18 by means of an adhesive, etc. at an area including the nozzle communication openings 30, without overlapping the opening region of the reservoir 35, in a state in which the nozzle communication openings 30 are in communication with the nozzles 16 respectively. In the present embodiment, each nozzle plate 17 has two rows of the nozzles 16 (nozzle groups) in total. In the present embodiment, each one nozzle row is made up of, for example, four hundred nozzles 16. Each nozzle 16 has an orifice in the lower surface of the nozzle plate 17, that is, the surface facing the recording medium 2 supported by the medium support 6. The orifice corresponds to a nozzle opening according to some aspects of the invention. In the present embodiment, as illustrated in FIG. 5, heat generation elements 37 functioning as an example of a control element are provided in the nozzle plate 17. A detailed explanation of this point will be given later. The nozzle group is not limited to nozzles arranged in a row. Nozzles arranged in a matrix may be adopted as the nozzle group. The gist is that it is sufficient as long as the nozzle group is made up of a plurality of nozzles to each of which a liquid is supplied from the same reservoir (common liquid room).

As illustrated in FIGS. 3 and 4, the compliance substrate 20, which has a through-hole opening 39 conforming to the contour shape of the nozzle plate 17 at its center, is bonded to the lower surface of the communication plate 18 in such a way as to surround the nozzle plate 17. The through-hole opening 39 of the compliance substrate 20 is in overlapping communication with the opening 15 of the fixing plate 14, and the nozzle plate 17 is located inside them.

The compliance substrate 20 is positioned and bonded to the lower surface of the communication plate 18; in this state, the opening at the bottom of the reservoir 35 in the lower surface of the communication plate 18 is hermetically closed by the compliance substrate 20. As illustrated in FIG. 4, in the present embodiment, the compliance substrate 20 includes the compliance sheet 40 and a supporting plate 41. The supporting plate 41 is bonded to the compliance sheet 40 and supports the compliance sheet 40. Since the compliance sheet 40 of the compliance substrate 20 is bonded to the lower surface of the communication plate 18, the compliance sheet 40 is sandwiched between the communication plate 18 and the supporting plate 41. The compliance sheet 40 is a flexible thin film and is made of a synthetic resin material, for example, polyphenylene sulfide (PPS) or the like. The supporting plate 41 is made of a metal material that has greater rigidity than that of the compliance sheet 40 and is thicker than the compliance sheet 40, for example, stainless steel or the like. The supporting plate 41 has a compliance opening 42 at the area facing the reservoir 35, wherein the compliance opening 42 is formed by removing a part of the supporting plate 41 in a shape conforming to the shape of the opening at the bottom of the reservoir 35. Therefore, the opening at the bottom of the reservoir 35 is hermetically closed solely by the compliance sheet 40, which has flexibility. In other words, a part of the reservoir 35 is demarcated by the compliance sheet 40.

In the bottom of the supporting plate 41, the portion corresponding to the compliance opening 42 is hermetically closed by the fixing plate 14. Therefore, a compliance space 47 is formed between the flexible region of the compliance sheet 40 and the fixing plate 14 facing it. In accordance with pressure vibration inside the ink flow passage, especially pressure vibration inside the reservoir 35, the flexible region of the compliance sheet 40 over the compliance space 47 changes its position into the reservoir 35 or into the compliance space 47. Therefore, the thickness of the supporting plate 41 is designed in accordance with the required height of the compliance space 47.

Referring back to FIG. 3, the actuator substrate 19 and the communication plate 18 are fixed to the case 21. In plan view, the case 21 has substantially the same shape as that of the communication plate 18. An accommodation space 43 for housing the actuator substrate 19 is formed in the bottom of the case 21. In a state in which the actuator substrate 19 is housed inside the accommodation space 43, the lower surface of the case 21 is fixed to the communication plate 18 for hermetic closure by it. As illustrated in FIG. 3, an insertion space 44, which is in communication with the accommodation space 43, is formed substantially at the center of the case 21 in plan view. The insertion space 44 is in communication with the wiring space 29 inside the actuator substrate 19, too. The aforementioned flexible substrate 28 is inserted into the wiring space 29 through the insertion space 44. The liquid room spaces 45, which are respectively in communication with the reservoirs 35 of the communication plate 18, are formed on respective two sides, with the insertion space 44 and the accommodation space 43 interposed therebetween, inside the case 21. The inlets 46, which are in communication with the liquid room spaces 45 respectively, are formed in the top of the case 21. Ink sent from the ink supply source, for example, an ink cartridge, flows through the inlet 46 into the liquid room space 45. The ink that has flowed through the inlet 46 into the liquid room space 45 flows into the reservoir 35 next. Then, the ink is supplied from the reservoir 35 to each of the pressure compartments 23 through the corresponding one of the individual communication openings 31.

The fixing plate 14 is a plate member that is made of metal, for example, stainless steel or the like. At a position corresponding to the nozzle plate 17, for exposing the nozzles 16 formed in the nozzle plate 17, the fixing plate 14 of the present embodiment has an opening 15 that is formed therethrough in the thickness direction and has a shape conforming to the contour shape of the nozzle plate 17. As described earlier, the opening 15 is in overlapping communication with the through-hole opening 39 of the compliance substrate 20. In the present embodiment, the lower surface of the fixing plate 14 and the exposed regions of the nozzle plates 17 at the openings 15 constitute the nozzle surface.

In the head unit 12 having the above structure, pressure vibration occurs in ink inside the pressure compartment 23 as a result of the driving of the piezoelectric element 25 in accordance with a drive signal (drive pulse Pd described later) applied from the driver IC 27 in a state in which the flow passage from the liquid room space 45 through the reservoir 35 and the pressure compartment 23 to the nozzle 16 is filled with ink. Due to the pressure vibration, the ink is ejected from the nozzle 16 as commanded. The compliance sheet 40 changes its position (deforms) in accordance with pressure vibration inside the ink flow passage, especially pressure vibration inside the reservoir 35, during the process of recording operation (liquid ejecting operation), and this flexural sheet behavior mitigates the pressure vibration.

Figure 6:
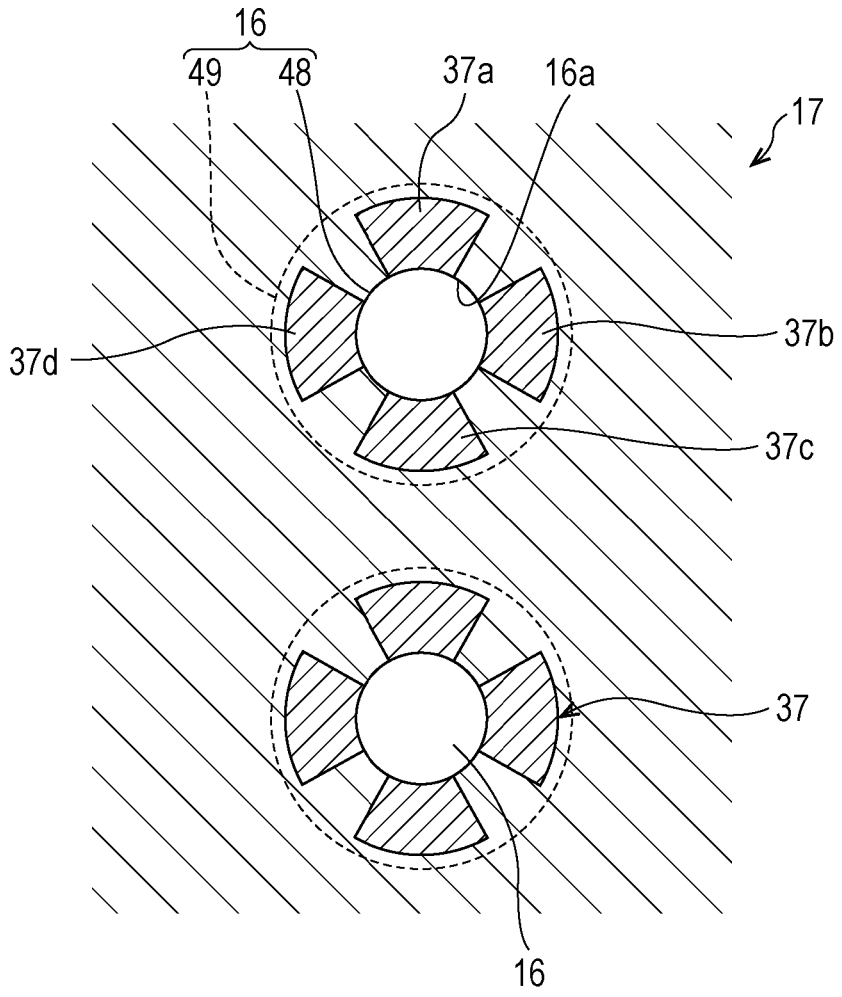
FIG. 6 is a plan view for explaining the structure of the neighborhood of nozzle orifices.

FIG. 5 is a cross-sectional view for explaining the structure of, in the head unit 12, a flow passage from the pressure compartment 23 to the nozzle orifice 16*a* (nozzle opening). FIG. 6 is a plan view for explaining the structure of the neighborhood of the nozzle orifices 16*a*. The nozzle 16 of the present embodiment has a two-tiered structure that is made up of a first nozzle portion 48 and a second nozzle portion 49. As viewed in the direction of ink ejection (the direction of the center axis of the nozzle), the first nozzle portion 48 is a downstream-side portion (closer to the nozzle orifice 16*a*), and the second nozzle portion 49 is an upstream-side portion (closer to the pressure compartment 23). These nozzle portions 48 and 49 are formed by processing a silicon substrate that is the material of the nozzle plate 17, for example, by dry etching. Both of these nozzle portions 48 and 49 are circular in plan view. The cross-sectional passage area size of the first nozzle portion 48 is smaller than that of the second nozzle portion 49. An ink droplet (a kind of liquid droplet) is ejected from the nozzle orifice 16*a* of the first nozzle portion 48 at the opposite of the second nozzle portion 49. The structure of the nozzle 16 is not limited to the example described and illustrated in the present embodiment. Various kinds of modified structure can be adopted, for example, a tier-less cylindrical nozzle structure that has a substantially constant inside diameter, a tapered nozzle structure whose portion corresponding to the second nozzle portion 49 decreases in cross-sectional passage area size from the upstream side toward the downstream side in a tapered manner, or the like.

Heat generation elements 37 (a kind of control element according to some aspects of the invention) are provided around each nozzle 16 of the nozzle plate 17. More specifically, for each nozzle orifice 16*a* of the nozzle plate 17, four heat generation elements 37*a* to 37*d* are evenly arranged at different positions at predetermined intervals along the rim of the opening of the first nozzle portion 48. That is, the heat generation elements 37 are arranged at predetermined intervals non-continuously along the rim of the nozzle orifice 16*a* in a state in which they are partially exposed to the inside of the flow passage. For example, a so-called film heater, a Peltier element, or the like, formed by shielding a heating wire such as a Nichrome wire by an insulator that has flexibility, can be used as the heat generation element 37. Preferably, one that offers a high response speed should be used. In the present embodiment, the heat generation elements 37 are provided respectively inside recesses 50 formed by, for example, dry etching at the peripheral area around the opening of the first nozzle portion 48. A non-illustrated lead wire from the heat generation element 37 is connected to a non-illustrated power supply via a relay 55 (see FIG. 7) as will be described later. The ON/OFF status of the heat generation element 37 is controlled by controlling the relay 55 using a control signal generated from the signal generation circuit 53. The number of the heat generation elements 37 provided at the peripheral area around the opening of the first nozzle portion 48, and the shape thereof, is not limited to the above example. The gist is that it is sufficient as long as the heat generation elements 37 are arranged in a balanced manner around the nozzle 16.

In the printer 1 according to some aspects of the invention, ink flowing through the flow passage from the pressure compartment 23 to the orifice 16*a* of the nozzle 16 is heated by the heat generation elements 37 along with ink ejecting operation. That is, heat that is a kind of energy is applied by the heat generation elements 37 to the ink flowing through the flow passage. The application of the energy produces an unstable part whose surface tension (surface free energy) differs partially in ink (liquid pillar) that is forced out from the nozzle orifice 16*a* by driving the piezoelectric element 25. This makes it easier for the liquid pillar to be split (become separated and released from the meniscus) at the unstable part. Therefore, by controlling the timing of heating the ink by the heat generation elements 37, it is possible to adjust the split position and split timing of the liquid pillar during the process of ink ejection from the nozzle orifice 16*a*. By this means, it is possible to adjust the amount of an ink droplet ejected from the nozzle orifice 16*a* and suppress the generation of a satellite droplet or mist accompanying the ejection of the ink droplet. This point will now be explained in more detail.

Figure 7:
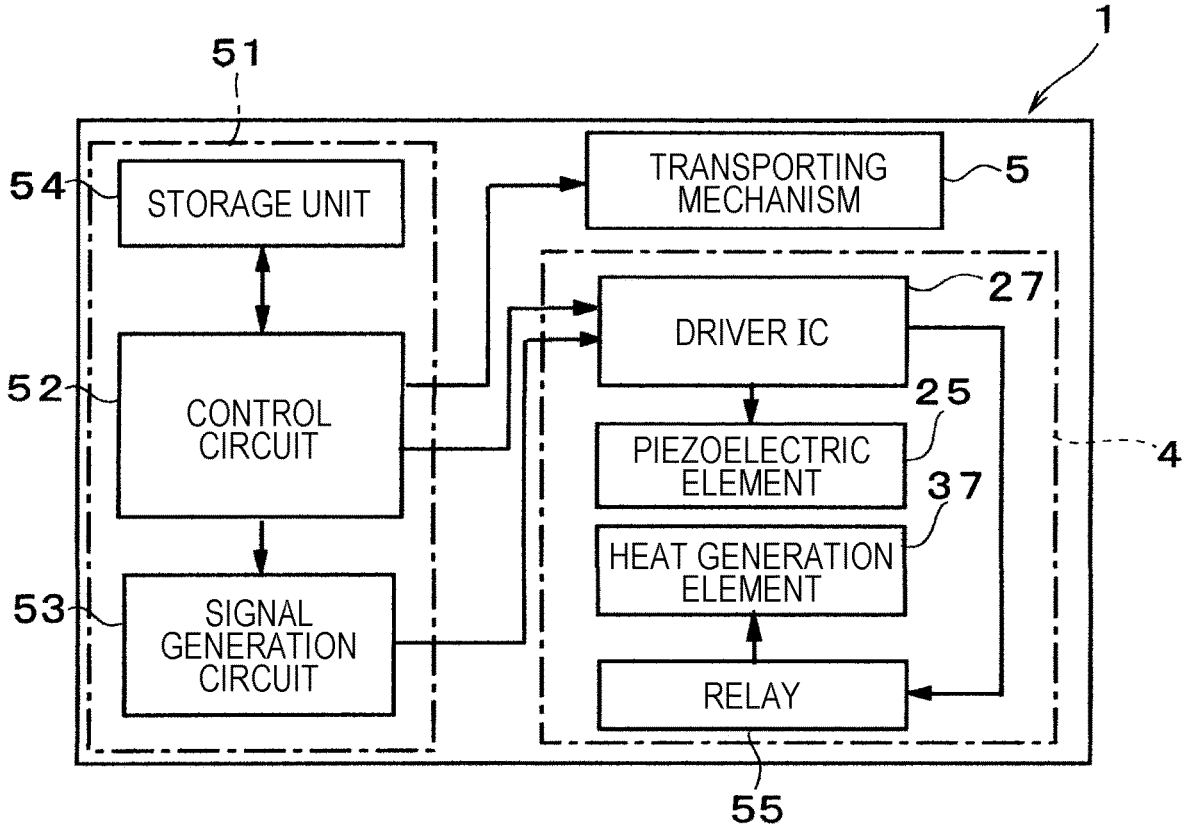
FIG. 7 is a block diagram that illustrates the electric configuration of a liquid ejecting apparatus.

FIG. 7 is a block diagram that illustrates the electric configuration of the printer 1. Although a single piezoelectric element 25 and a single heat generation element 37 only are illustrated in FIG. 7, in the present embodiment, actually, a plurality of piezoelectric elements 25 and a plurality of heat generation elements 37 are provided to correspond to a plurality of nozzles 16 of the recording head 4 respectively. The driver IC 27 is provided for each of the plurality of head units 12. In the printer 1 of the present embodiment, each component is controlled by a printer controller 51. The printer controller 51 of the present embodiment includes a control circuit 52, a storage unit 54, and a signal generation circuit 53. The storage unit 54 is a device that stores the programs of the control circuit 52 and data used for various kinds of control. The storage unit 54 includes a ROM, a RAM, and an NVRAM (nonvolatile memory device). In addition to the programs and data, as will be described later, information regarding the timing of generation of a control pulse Cs in a control signal and information regarding the set temperature of the heat generation element 37 are stored in the storage unit 54.

The control circuit 52 is an arithmetic processor for controlling the entire printer operation. The control circuit 52 includes a CPU, etc. that is not illustrated. The control circuit 52 controls each unit in accordance with the programs, etc. stored in the storage unit 54. In addition, in the present embodiment, on the basis of print data received from an external device, etc., the control circuit 52 generates ejection data that specifies the details of ejection performed during print operation (liquid ejecting operation), for example, from which nozzles 16 of which head units 12 of the recording head 4 ink droplets should be ejected, at which timing ink droplets should be ejected, and ink droplets of which size should be ejected. Then, the control circuit 52 transmits the ejection data to the driver IC 27 (head controller) of the recording head 4.

In addition, the control circuit 52 generates a timing pulse PTS from an encoder pulse that is outputted in accordance with the transportation of the recording medium 2 by the transporting mechanism 5. In synchronization with the timing pulse PTS, the control circuit 52 controls the transfer of the ejection data, controls the generation of a drive signal by the signal generation circuit 53, and the like. Furthermore, on the basis of the timing pulse PTS, the control circuit 52 generates a latch signal LAT, which is a kind of timing signal, and outputs it to the driver IC 27 of the recording head 4. Each time when the timing pulse PTS is received, the signal generation circuit 53 mentioned above generates a drive signal for driving the piezoelectric element 25 and a control signal for ON/OFF control of the heat generation element 37.

On the basis of the ejection data and the timing signal from the control circuit 52, the driver IC 27 selectively applies, to the piezoelectric elements 25, the drive pulse Pd (FIG. 8) included in the drive signal from the signal generation circuit 53. As a result of this operation, the piezoelectric elements 25 are driven, and ink droplets are ejected from the nozzles 16. In addition, the driver IC 27 performs ON/OFF control of the heat generation element 37 via the relay 55 in accordance with the control signal outputted from the signal generation circuit 53. That is, in the present embodiment, the ON/OFF control of the heat generation element 37 is performed at the recording-head side 4. The ON/OFF control of the heat generation element 37 via the relay 55 in accordance with the control signal may be performed directly from the signal generation circuit 53. That is, the ON/OFF control of the heat generation element 37 may be performed at the printer controller 51 (printer-body side).

Figure 8:
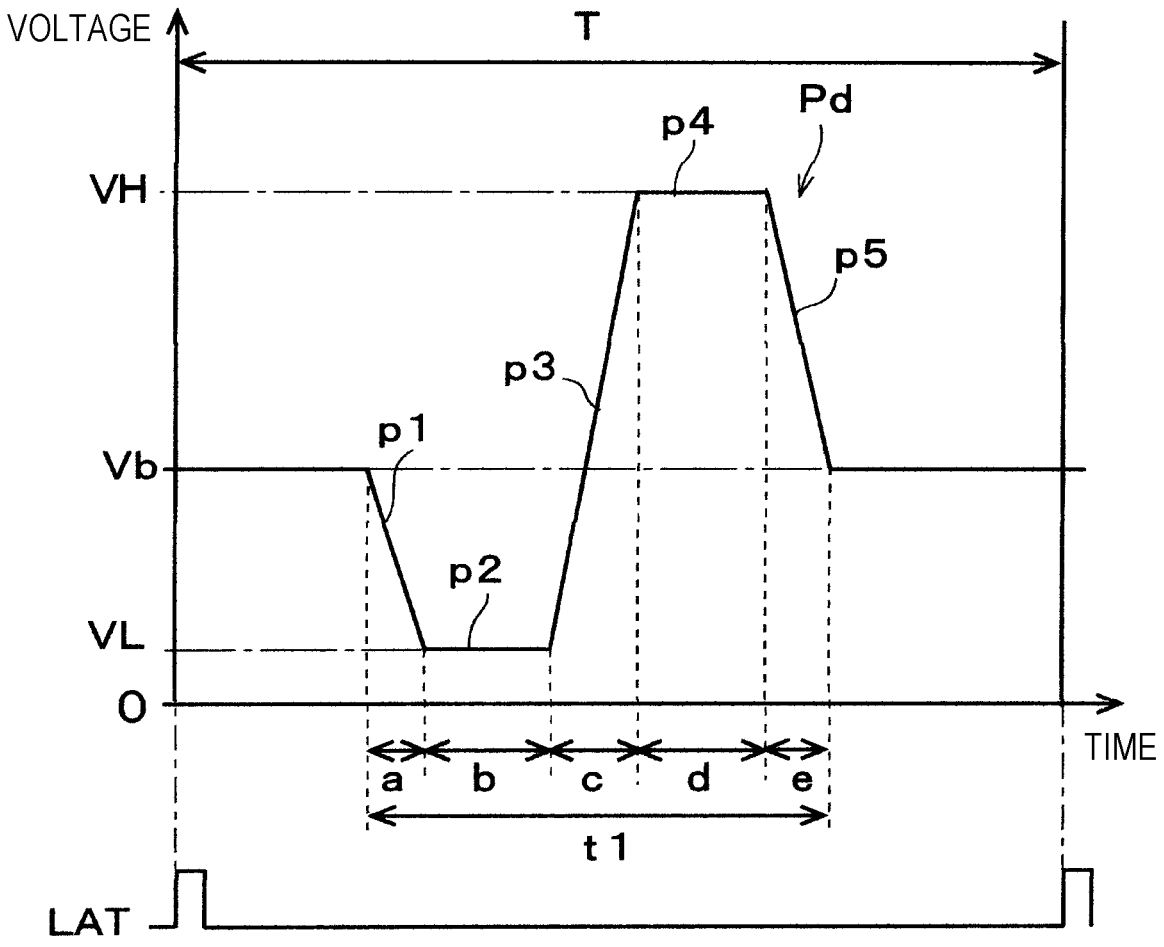
FIG. 8 is a waveform chart for explaining an example of a drive pulse.
Figure 9:
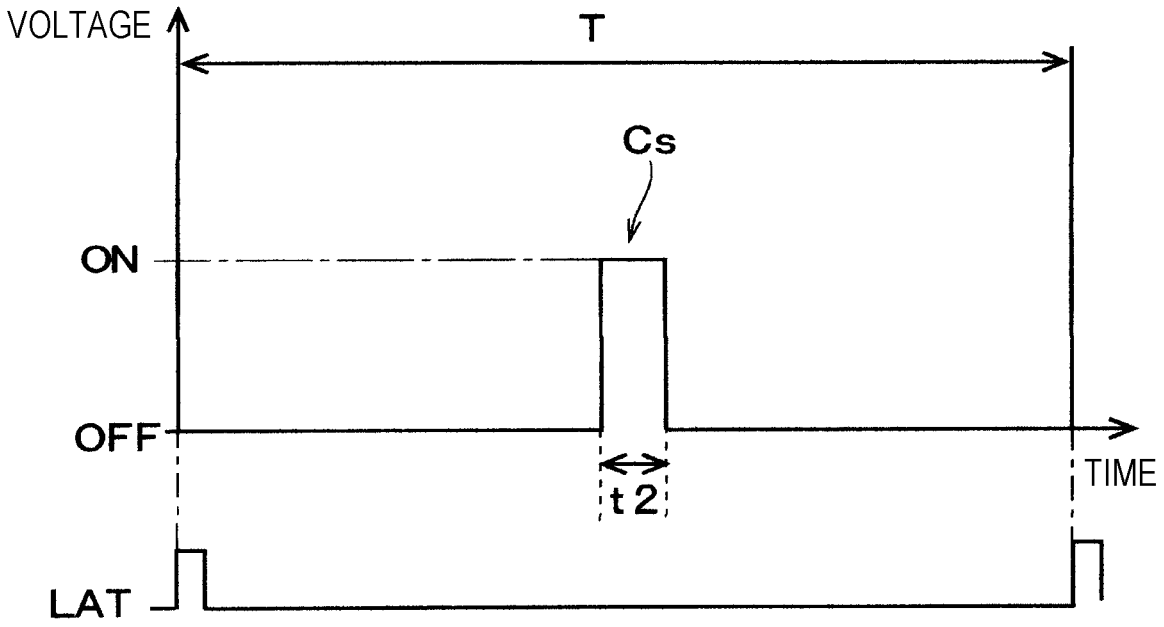
FIG. 9 is a waveform chart for explaining an example of a control pulse.

FIG. 8 is a waveform chart that illustrates an example of a drive pulse Pd included in a drive signal for driving the piezoelectric element 25 to eject an ink droplet from the nozzle 16. FIG. 9 is a waveform chart that illustrates an example of a control signal (control pulse Cs) regarding ON/OFF control of the heat generation element 37. Both in FIG. 8 and in FIG. 9, the waveform is shown with correspondence to the latch signal LAT, which is a kind of timing signal outputted from the control circuit 52.

The drive pulse Pd of the present embodiment is made up of a preliminary expansion element p1, an expansion hold element p2, a contraction element p3, a contraction hold element p4, and a return expansion element p5. The preliminary expansion element p1 is a waveform element in which the voltage level changes from a base voltage level Vb to an expansion voltage level VL, which is lower than the base voltage level Vb. The expansion hold element p2 is a waveform element in which the voltage level is kept for a predetermined length of time at the expansion voltage level VL, which is the end level of the preliminary expansion element p1. The contraction element p3 is a waveform element in which the voltage level changes with a relatively steep slope from the expansion voltage level VL to a contraction voltage level VH, which is higher than the base voltage level Vb. The contraction hold element p4 is a waveform element in which the voltage level is kept for a predetermined length of time at the contraction voltage level VH. The return expansion element p5 is a waveform element in which the voltage level returns from the contraction voltage level VH to the base voltage level Vb. As will be described later, applying the drive pulse Pd to the piezoelectric element 25 causes the deformation of the piezoelectric element 25 in accordance with the change in the voltage level of the drive pulse Pd. The deformation gives rise to a change in pressure (pressure variation) in ink inside the pressure compartment 23. As a result of this pressure change, an ink droplet is ejected from the nozzle 16 (nozzle orifice 16*a*). The drive pulse Pd is not limited to the above example. A drive pulse with various well-known waveforms can be used depending on the configuration of the piezoelectric element 25.

The control signal includes a control pulse Cs for controlling the relay 55, which is provided on a power supply path between a power supply and the heat generation element 37. The generation of the control pulse Cs is linked with the generation of the drive pulse Pd included in the drive signal (a detailed explanation will be given later). The power supply path is switched from a disconnected state to a connected state due to the control of the relay 55 in accordance with the control pulse Cs, and the switching turns power supply to the heat generation element 37 into an ON state. It is preset that, in this ON state, the heat generation element 37 generates heat to give rise to a preset temperature increase from its power-disconnected OFF-state temperature, for example, an increase of approx. 20° C. to approx. 40° C. That is, for example, if the temperature of the heat generation element 37 in the OFF state is 25° C. (room temperature), the temperature of the heat generation element 37 rises into a range from 45° C. inclusive to 65° C. inclusive when in the ON state. Because of this temperature increase, heat that is a kind of energy is applied from the heat generation element 37 to ink in the flow passage from the pressure compartment 23 to the orifice 16*a* of the nozzle 16. The set temperature of the heat generation element 37 is determined on the basis of set temperature information pre-stored in the storage unit 54 as will be described later.

In the present embodiment, heat is applied by the heat generation elements 37 to ink near the orifice 16*a* of the nozzle 16. The temperature range mentioned above is a temperature range that realizes a change in the surface tension of ink. Since energy (in the present embodiment, heat) is applied locally to ink as described above, the following state is produced: a state in which the surface tension (dynamic surface tension) of a part of ink forced out in the form of a liquid pillar (see FIG. 13) from the nozzle orifice 16*a* by driving the piezoelectric element 25 by means of the drive pulse Pd is different from the surface tension of other part of the liquid pillar. In other words, local energy application produces an unstable state (unstable part). The surface tension of the part whose temperature has become higher than the temperature of the other part of the liquid due to the applying of heat is lower than the surface tension of the other part. The unstable part, the surface tension of which is relatively low, is pulled to the part the surface tension of which is relatively high. This makes it easier for the liquid pillar forced out from the nozzle orifice 16*a* to be split at the unstable part.

The control pulse Cs described above is generated within a period from after a timing signal (LAT signal or CH signal) defining a drive signal generation cycle T including the duration ("generation period") t1 of the drive pulse Pd to the end of the drive pulse Pd (the end of the return expansion element p5). It is set that the duration (pulse width) of the control pulse Cs in the present embodiment, that is, the period t2 during which the heat generation elements 37 are ON, at least partially overlaps the duration t1 of the drive pulse Pd. More specifically, the timing of generation of the control pulse Cs and the duration t2 of the control pulse Cs are set such that the heat generation elements 37 will be turned ON at any timing during the execution of ink ejecting operation by driving the piezoelectric element 25 by means of the drive pulse Pd at the corresponding nozzle 16. Since the control pulse Cs is generated in this way correspondingly to the timing of generating the drive pulse Pd for ink ejecting operation, the applying of energy to ink by the heat generation elements 37 in link with the ejecting operation based on the drive pulse Pd is performed at more appropriate timing, and a desired part of ink in the flow passage from the pressure compartment 23 to the orifice 16*a* of the nozzle 16 is heated. Moreover, the duration t2 described above is set to be shorter than the period in which ink is forced out from the nozzle orifice 16*a* by driving the piezoelectric element 25 by means of the drive pulse Pd, that is, shorter than the duration c of the contraction element p3. For this reason, during the process of the forming of the liquid pillar of the ink forced out from the nozzle orifice 16*a*, the ink is heated more locally. Therefore, adverse effects on the ejection of an ink droplet due to excessive energy application are prevented.

Figure 10:
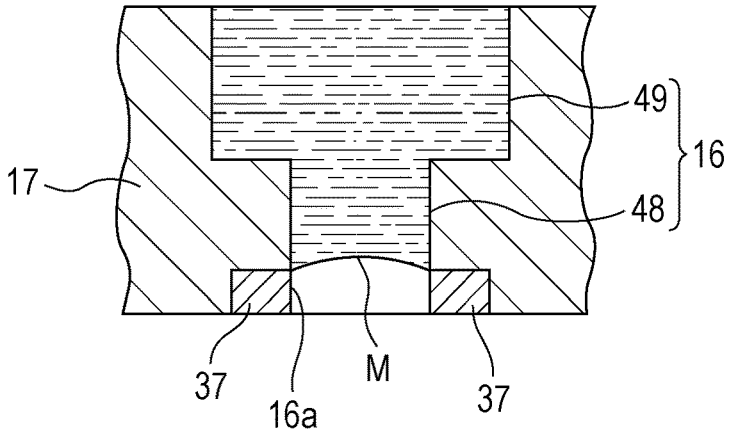
FIG. 10 is a process diagram for explaining an ejection process.
Figure 11:
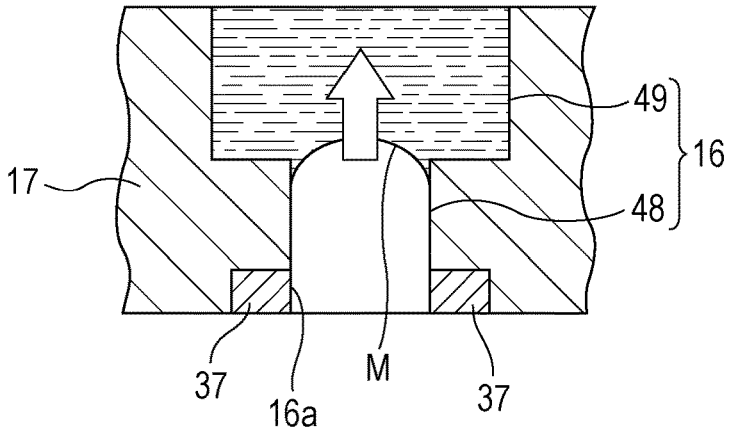
FIG. 11 is a process diagram for explaining an ejection process.

FIGS. 10 to 14 are schematic diagrams of a control method according to an exemplary embodiment of the invention for explaining ejection processes (liquid ejecting operation) for ejecting an ink droplet from the nozzle 16 by driving the piezoelectric element 25 by means of the drive pulse Pd. In FIG. 10, a state of ink inside the nozzle 16 before the drive pulse Pd is applied to the piezoelectric element 25 is illustrated. In this state, the base voltage level Vb in a drive signal is continuously applied to the piezoelectric element 25 and, therefore, inside the nozzle 16 and the pressure compartment 23, there is no pressure change that is to be caused by driving the piezoelectric element 25. For this reason, the meniscus M inside the nozzle 16 stays at the ejection side of the first nozzle portion 48, that is, at the initial position (base position) near the nozzle orifice 16*a*. When the drive pulse Pd described above is applied to the piezoelectric element 25 from this state, first, the piezoelectric element 25 deforms toward the outside of the pressure compartment 23 (away from the nozzle 16) due to the supply of the preliminary expansion element p1. Accordingly, the pressure compartment 23 expands to increase its capacity from base capacity, which corresponds to the base voltage level Vb, to expansion capacity, which corresponds to the expansion voltage level VL. As illustrated in FIG. 11, the expansion causes the meniscus M in the nozzle 16 to be pulled in toward the pressure compartment 23 (upward in the drawing) significantly. The expanded state of the pressure compartment 23 continues for a predetermined length of time due to the supply of the expansion hold element p2.

Figure 12:
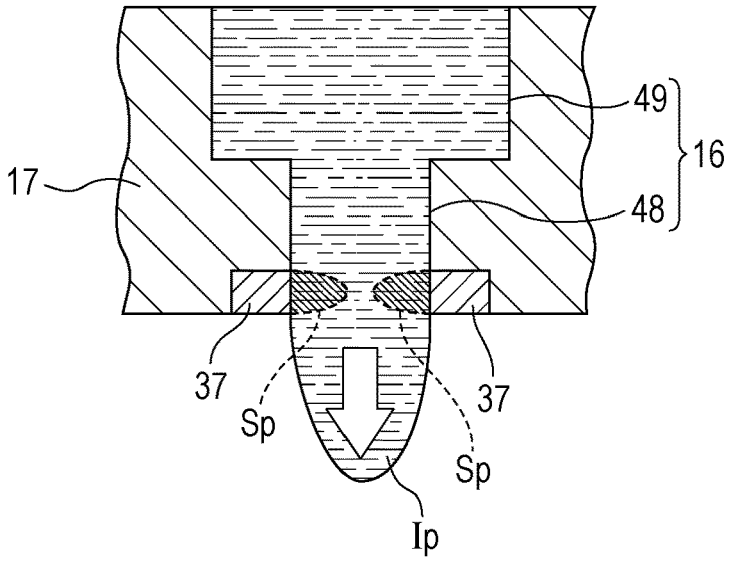
FIG. 12 is a process diagram for explaining an ejection process.

After holding by the expansion hold element p2, the piezoelectric element 25 deforms toward the inside of the pressure compartment 23 (toward the nozzle 16) due to the supply of the contraction element p3. Accordingly, the pressure compartment 23 contracts to decrease its capacity sharply from the expansion capacity to contraction capacity, which corresponds to the contraction voltage level VH. This capacity decrease pressurizes the ink inside the pressure compartment 23. Therefore, as illustrated in FIG. 12, the ink inside the nozzle 16 is pushed toward the ejection side (downward in the drawing), and is forced out from the nozzle orifice 16*a* (toward the medium support 6), resulting in that a liquid pillar Ip is produced. In the present embodiment, the heat generation elements 37 are switched ON at this timing by the control pulse Cs for the duration t2 thereof (energy applying process). Therefore, the temperature of the heat generation elements 37 increases, and the heat of the heat generation elements 37 is transferred to the ink near the nozzle orifice 16*a*. That is, the heat, as an example of energy, is applied to the ink in the flow passage by the heat generation elements 37. The heat-applied part of the ink is denoted as Sp in the drawing.

Figure 13:
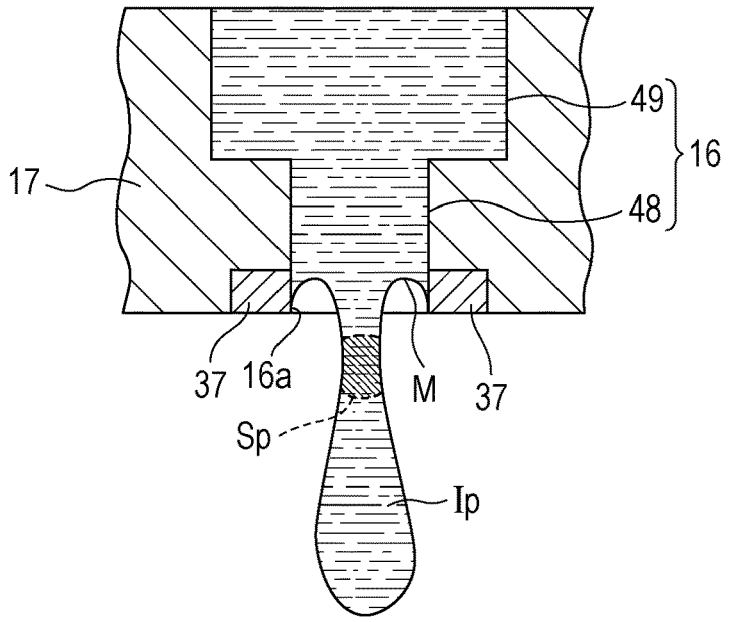
FIG. 13 is a process diagram for explaining an ejection process.
Figure 14:
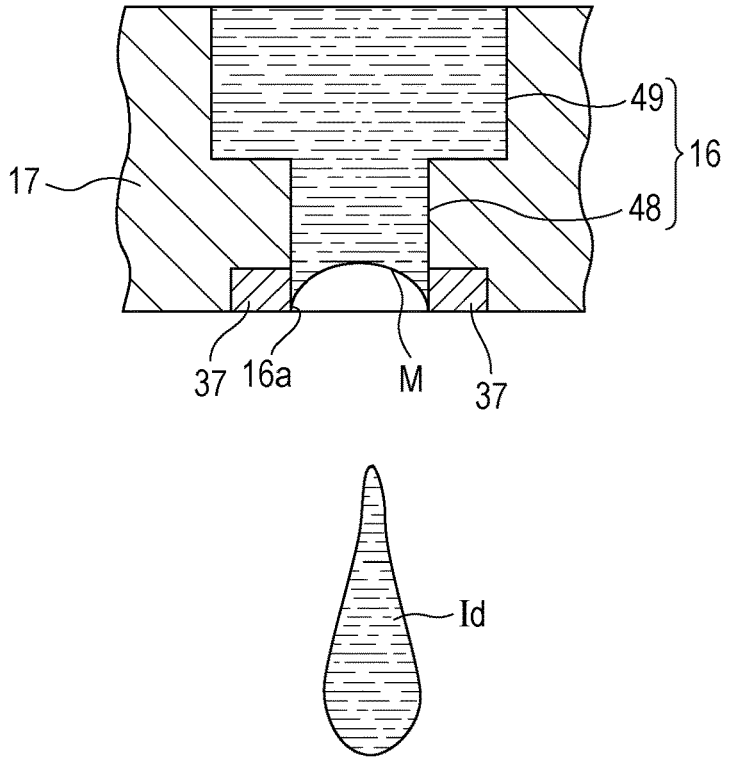
FIG. 14 is a process diagram for explaining an ejection process.

Next, the contraction hold element p4 is supplied so as to keep the pressure compartment 23 contracted for a predetermined length of time. During this period, as illustrated in FIG. 13, because of inertia, the ink forced out in the form of the liquid pillar Ip beyond the nozzle orifice 16*a* becomes stretched in the ejecting direction. Since heat is applied from the heat generation elements 37 to the part between the head (the part that forms into an ink droplet Id (FIG. 14)) of the liquid pillar Ip and the meniscus M, an unstable part Sp, the surface tension (dynamic surface tension) of which is lower than the surface tension of other part of the liquid pillar Ip, is produced. After holding by the contraction hold element p4, the return expansion element p5 is applied to the piezoelectric element 25 to bring the piezoelectric element 25 back to the base position. Accordingly, the pressure compartment 23 expands to increase its capacity from the contraction capacity to the base capacity. The liquid pillar Ip is split at the unstable part Sp to be released from the meniscus M because the meniscus M is pulled in the opposite direction in a state in which the liquid pillar Ip is stretching in the ejecting direction due to the inertial force and because the dynamic surface tension is low at the unstable part Sp. Finally, as illustrated in FIG. 14, the part released from the meniscus moves in the air in the form of an ink droplet Id toward the recording medium 2 on the medium support 6.

As explained above, in an ejection step (liquid ejecting operation) for ejecting an ink droplet Id from the nozzle 16, heat, as a kind of energy, is applied from the heat generation elements 37, as a kind of control element, to ink in the flow passage from the pressure compartment 23 to the nozzle 16. Because of the applying of heat, in the ink forced out in the form of the liquid pillar Ip from the nozzle orifice 16*a* by driving the piezoelectric element 25 by means of the drive pulse Pd, an unstable part Sp whose surface tension (dynamic surface tension) is different from the surface tension of other part of the ink is produced. This makes it easier for the liquid pillar Ip to be split at the unstable part Sp between the head portion of the liquid pillar Ip, in other words, the part ejected from the nozzle orifice 16*a* to become an ink droplet Id, and the meniscus M. That is, the release of the head portion of the liquid pillar Ip from the meniscus M is facilitated. By controlling the applying of energy to ink by the heat generation elements 37, it is possible to adjust ejection characteristics. Therefore, it is possible to reduce variations in ejection characteristics due to, for example, individual differences in the recording head 4, in particular, variations in ejection characteristics due to individual differences among the head units 12, more effectively. Moreover, since the liquid pillar Ip forced out from the nozzle orifice 16*a* to turn into the ink droplet Id is not excessively stretched, the forming of a tail of the ink droplet Id is suppressed, resulting in a reduction in the generation of a satellite droplet or mist. Consequently, it is possible to prevent a decrease in the quality of an image recorded on a recording medium and prevent the staining of the inside of the printer 1 by mist.

The heat generation elements 37 as a kind of control element can be provided somewhere on the flow passage from the pressure compartment 23 to the orifice 16*a* of the nozzle 16. In the present embodiment, the heat generation elements 37 as a kind of control element are arranged at the peripheral area around the nozzle 16. Since this structure reduces the timing difference between the point in time of applying energy to ink by the heat generation elements 37 and the point in time of ejecting an ink droplet from the nozzle orifice 16*a* (the point in time of release of the liquid pillar Ip forced out from the nozzle orifice 16*a* from the meniscus inside the nozzle 16), dispersion of the energy applied to the ink inside the ink during the process is suppressed, and a resultant decrease in the energy is also suppressed. Therefore, it is possible to adjust ejection characteristics with high precision. In the present embodiment, the heat generation elements 37 are arranged, with exposure to the nozzle orifice 16*a*, at predetermined intervals non-continuously along the rim of the nozzle orifice 16*a*. Since this structure further reduces the timing difference between the point in time of applying energy to ink by the heat generation elements 37 and the point in time of ejecting an ink droplet from the nozzle orifice 16*a*, the precision in adjustment of ejection characteristics further improves. Furthermore, since the heat generation elements 37 are arranged at predetermined intervals non-continuously along the rim of the nozzle orifice 16*a*, that is, since the heat generation elements 37 are arranged in a balanced manner around the nozzle orifice 16*a*, it is possible to apply energy to ink without an imbalance in the circumferential direction of the nozzle orifice 16*a*. Therefore, it is possible to prevent an ink droplet ejected from the nozzle orifice 16*a* from deviating from the target direction in the air.

The timing at which energy (in the present embodiment, heat) is applied to the ink in the flow passage by the heat generation element 37 in the ejecting operation described above, that is, the timing of the ON/OFF control of the heat generation element 37 by means of the control pulse Cs, and the set temperature of the heat generation element 37, are preset into such timing and temperature that make the ejection characteristics of the head units 12 mounted on the recording head 4 uniformly equal to a design target value, wherein the preset timing and temperature are determined by, for example, actually acquiring the ejection characteristics such as the amount of an ink droplet ejected from the nozzle 16 by using the drive pulse Pd described above. Therefore, the timing of generating the control pulse Cs in relation to the duration t1 of the drive pulse Pd, and the set temperature of the heat generation element 37, are set into suitable values depending on, for example, individual differences among the head units 12, the position where the heat generation element 37 is provided on the flow passage from the pressure compartment 23 to the nozzle 16, and the like. Then, information regarding the timing of generating the control pulse Cs and information regarding the set temperature of the heat generation element 37 are stored in, for example, the storage unit 54 in association with each head unit 12 or each head block 3. The information regarding the timing of generating the control pulse Cs and the information regarding the set temperature of the heat generation element 37 may be corrected in accordance with, for example, a change in ambient temperature, the result of re-testing of the ejection characteristics at the time of maintenance, and the like. By this means, it is possible to keep the ejection characteristics at the design target value irrespective of a change in ambient temperature, and the like.

In order to enhance the effect that is produced by applying energy to the ink in the flow passage by the heat generation element 37, preferably, the ink should contain a composite that has surface activity, that is, a surface-active agent. The movement of the surface-active agent in the ink due to the energy applied by the heat generation element 37 causes a greater change in dynamic surface tension. Therefore, it is possible to more actively reduce the surface tension of the part of the liquid pillar Ip. This makes it easier for the liquid pillar Ip to be split at the part. Consequently, the adjustment of ejection characteristics becomes easier. Furthermore, it is possible to suppress a satellite droplet, etc. more reliably. The surface-active agent may be selected from, though not limited to, a group consisting of an acetylenic glycol surface-active agent, an acetylenic alcohol surface-active agent, and a polysiloxane surface-active agent.

Figure 15:
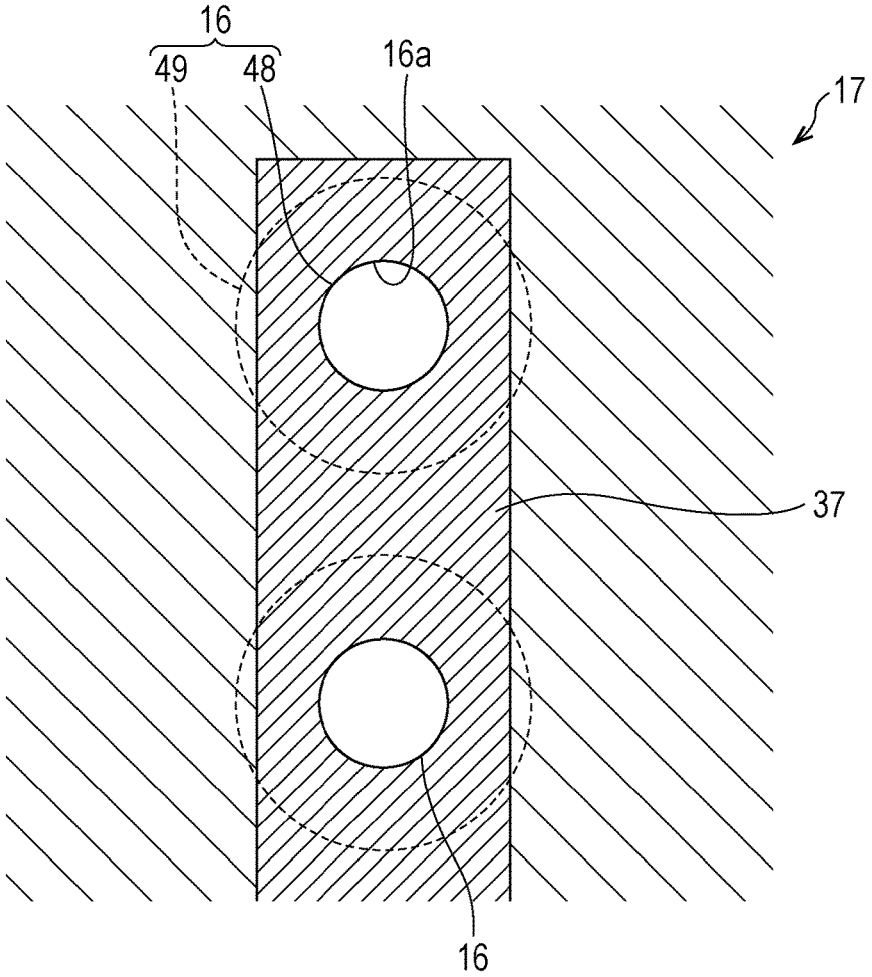
FIG. 15 is a plan view for explaining the structure of the neighborhood of nozzle orifices according to a variation example.

FIG. 15 is a plan view of the neighborhood of the nozzle orifices 16*a* for explaining a variation example of the heat generation element 37. In the embodiment described above, the heat generation elements 37 (37*a* to 37*d*) are provided individually for each nozzle 16. However, the scope of the invention is not limited to the foregoing example. In the present embodiment, a heat generation element 37 is provided in a shared manner across a plurality of nozzles 16. That is, for example, the heat generation element 37 may be provided for each nozzle row or for each head unit 12. This structure makes it easier to design the array layout of the heat generation element 37. Moreover, since ON/OFF control of the heat generation element 37 is performed on a nozzle-row-by-nozzle-row basis or on a head-unit-by-head-unit (12) basis, the circuitry is simplified, which contributes to reducing cost. The position where the heat generation element 37 is provided is not limited to the periphery of the nozzle orifice 16*a*. The heat generation element 37 may be provided at any arbitrary position on the flow passage from the pressure compartment 23 to the nozzle orifice 16*a*. In this case, the timing of generating the control pulse Cs in relation to the drive pulse Pd is set suitably for the position where the heat generation element 37 is provided. For example, in a case where the heat generation element 37 is provided at a position closer to the pressure compartment 23 than the periphery of the nozzle orifice 16*a*, the timing of generating the control pulse Cs is made earlier. Other structure is the same as that of the foregoing first embodiment.

Figure 16:
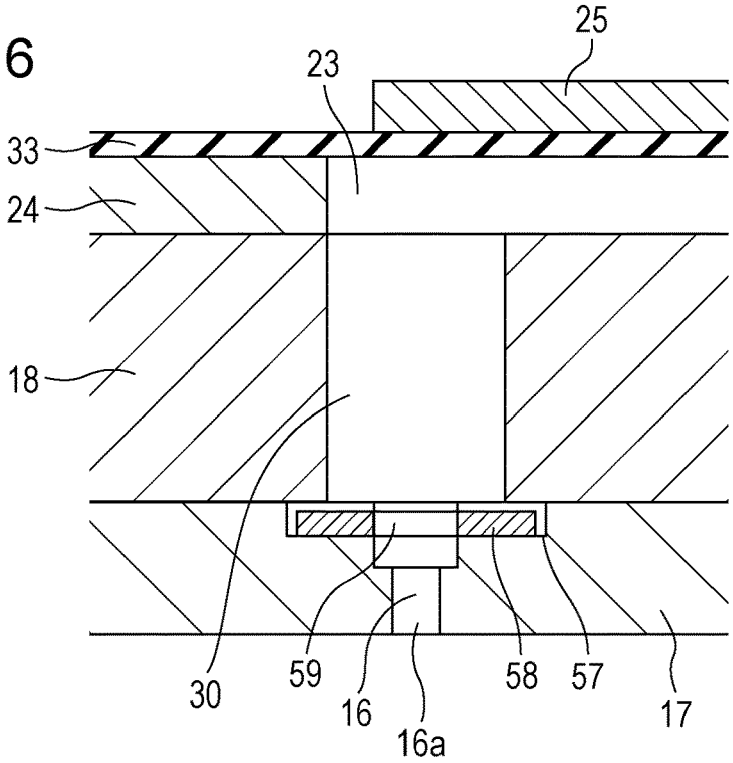
FIG. 16 is a cross-sectional view for explaining the structure of a flow passage from a pressure compartment to a nozzle orifice according to a second embodiment.

FIG. 16 is a cross-sectional view for explaining the structure of a flow passage from the pressure compartment 23 to the nozzle orifice 16*a* according to a second embodiment. In the foregoing first embodiment, the heat generation element 37 is explained as an example of a control element according to some aspects of the invention. However, the scope of the invention is not limited to the foregoing example. In the present embodiment, a resonance plate 58, which is provided on the flow passage from the pressure compartment 23 to the nozzle orifice 16*a*, and the piezoelectric element 25 constitute a vibration element that is an example of a control element according to some aspects of the invention. That is, the piezoelectric element 25, which functions as an example of a drive element for ink ejection, operates together with the resonance plate 58 to co-function also as an example of a control element. The resonance plate 58 is, for example, a disc-shaped plate member made of metal such as stainless steel. The resonance plate 58 is provided inside a recess 57 formed by, for example, dry etching at the peripheral area around the opening of the second nozzle portion 49. The resonance plate 58 is provided in a state in which it is allowed to move slightly inside the recess 57 (loose fit). The resonance plate 58 has a flow hole 59 at its center. Ink is able to pass through the flow hole 59. The inside diameter of the flow hole 59 is set to be approximately equal to or slightly greater than the diameter of the opening of the second nozzle portion 49. The piezoelectric element 25 of the present embodiment is configured to transmit, via the ink in the flow passage, vibration that occurs when it (the piezoelectric element itself) is driven, thereby causing the resonance plate 58 to vibrate (resonant vibration). Due to the resonant vibration of the resonance plate 58, vibration energy that is a kind of energy is applied to the ink in the flow passage. The application of the energy makes the surface tension of ink (liquid pillar) that is forced out from the nozzle orifice 16*a* by driving the piezoelectric element 25 partially different and gives rise to instability in the liquid pillar. This makes it easier for the liquid pillar to be split at the unstable part.

Figure 17:
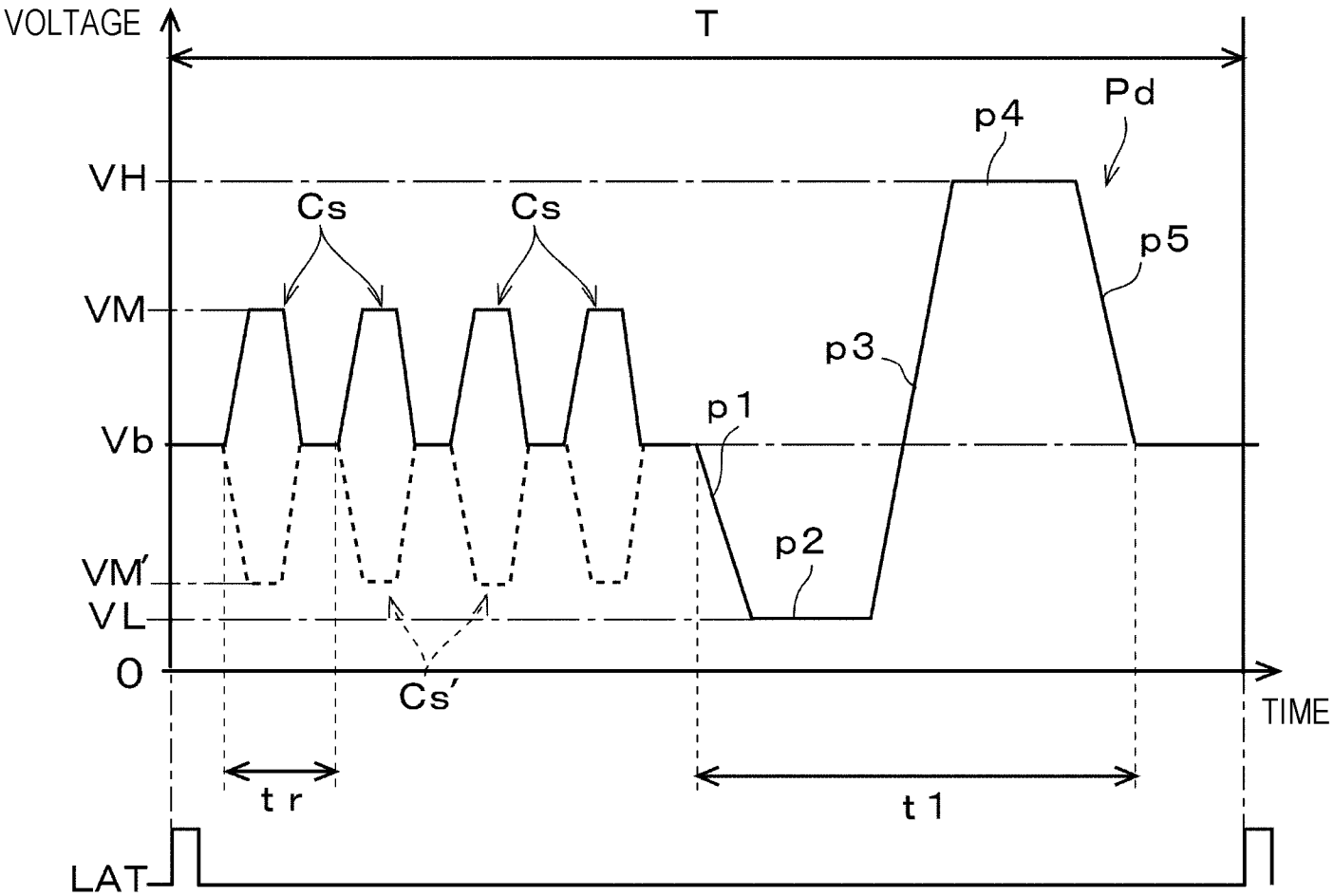
FIG. 17 is a waveform chart for explaining an example of drive vibration according to a second embodiment.

FIG. 17 is a waveform chart that illustrates an example of a drive signal according to the second embodiment. In the present embodiment, the piezoelectric element 25 that functions as an example of a drive element functions also as a vibration element that is a kind of control element. Therefore, the drive signal includes control pulses Cs for the function of the control element. Specifically, in the drive signal generation cycle T defined by the latch signal LAT, which is a kind of timing signal, a plurality of control pulses Cs is generated before the drive pulse Pd. In the present embodiment, the control pulse Cs is a pulse whose voltage level changes between the base voltage level Vb and an intermediate voltage level VM, which is between the base voltage level Vb and the contraction voltage level VH of the drive pulse Pd. Therefore, when the control pulse Cs is applied to the piezoelectric element 25, the piezoelectric element 25 deforms slightly toward the inside of the pressure compartment 23 and thereafter returns to its original position. The plurality of control pulses Cs (in the example illustrated in FIG. 17, four pulses) is generated at a cycle tr that is able to cause the resonance plate 58 provided near the nozzle 16 to vibrate in resonance. That is, the control pulses Cs cause the piezoelectric element 25 to vibrate at a frequency higher than the maximum frequency of the drive pulse Pd applied to the piezoelectric element 25 (for example, at 20 [kHz] or higher). As indicated by the broken line in FIG. 17, the control pulse may be a control pulse Cs' whose voltage level changes between the base voltage level Vb and a voltage level VM', which is between the base voltage level Vb and the expansion voltage level VL. In this case, the piezoelectric element 25 deforms slightly toward the outside of the pressure compartment 23 and thereafter returns to its original position.

In an ejection step (ejecting operation) for ejecting an ink droplet, first, the plurality of control pulses Cs is applied successively to the piezoelectric element 25. As a result, the piezoelectric element 25 vibrates, and the resonance plate 58 vibrates in resonance with it. The vibration of the resonance plate 58 (that is, vibration energy that is a kind of energy) is applied to the ink near the nozzle 16. The application of the vibration energy partially decreases the surface tension (dynamic surface tension) of ink (liquid pillar) that is forced out from the nozzle orifice 16*a* and gives rise to instability in the liquid pillar. This makes it easier for the liquid pillar to be split at the unstable part. For easy control of the position of separation into the ink droplet Id from the liquid pillar Ip, the position of the resonance plate 58 on the flow passage and the timing of applying the control pulses Cs are set suitably.

Preferably, a member that is harder than the members constituting the flow passage, for example, the nozzle plate 17 and the communication plate 18, etc., and has a high natural frequency should be used as the resonance plate 58 described above. Since such a member causes the resonance plate 58 to resonate (vibrate) at a higher frequency, it is possible to decrease the surface tension of ink more. The piezoelectric element that functions as the control element (vibration element) is not limited to the piezoelectric element 25 that is used for ejecting operation. A different piezoelectric element that is not the piezoelectric element 25 may be provided, and this piezoelectric element may cause the resonance plate 58 to vibrate in resonance. Alternatively, instead of providing the resonance plate 58, a different piezoelectric element that is not the piezoelectric element 25 may be provided, and this piezoelectric element may apply vibration directly to ink. In these structure examples, it is possible to separate the control signal including the control pulses Cs from the drive signal including the drive pulse Pd. Therefore, as done in the first embodiment, it is possible to generate the control pulses Cs in such a way as to at least partially overlap the duration t1 of the drive pulse Pd. That is, it is possible to apply the energy produced by the vibration element to the ink in the flow passage during the execution of operation for ejecting ink by driving the piezoelectric element 25 by means of the drive pulse Pd. Other structure is the same as that of the foregoing first embodiment. Instead of providing the heat generation elements 37 according to the first embodiment, a different piezoelectric element that is not the piezoelectric element 25 may be provided as the vibration element, and this piezoelectric element may apply vibration directly to ink.

In each of the foregoing embodiments, a so-called line printer that includes the recording head 4 including the plurality of head units 12 mounted on the holder 8 and is configured to perform print operation while transporting the recording medium 2 without scanning the recording head 4 is taken as an example. However, the scope of the invention is not limited thereto. The invention may be applied to a so-called serial printer that performs print operation while performing reciprocating scan of its recording head in the width direction of the recording medium.

The invention can be applied to various liquid ejecting apparatuses, not limited to the printer 1 described above; some non-limiting examples of application are: various ink-jet recording apparatuses such as a plotter, a facsimile machine, a copying machine, and a textile printing apparatus configured to perform textile printing by ejecting ink from a liquid ejecting head onto fabric (textile printing target) that is a kind of the target of droplet landing.

The entire disclosure of Japanese Patent Application No. 2017-121987, filed Jun. 22, 2017 is expressly incorporated by reference herein.

What is claimed is:

1. A liquid ejecting head, comprising:

a nozzle that has a nozzle opening from which liquid is ejected;

a pressure compartment that is in communication with the nozzle;

a drive element configured to vary pressure of the liquid inside the pressure compartment for ejecting the liquid from the nozzle opening; and a control element configured to apply energy to the liquid in a flow passage from the pressure compartment to the nozzle opening, wherein the drive element is a piezoelectric drive element that is configured to receive a first driving pulse configured to cause the piezoelectric drive element to vary the pressure inside the pressure compartment, the first driving pulse being further configured to function in conjunction with a second driving pulse that is configured to cause the control element to apply the energy to the liquid in the flow passage such that the control element makes surface tension of a part of the liquid forced out from the nozzle opening by driving the drive element with the first driving pulse different from surface tension of other part of the liquid.

2. The liquid ejecting head according to claim 1, wherein the control element is provided at periphery of the nozzle.

3. The liquid ejecting head according to claim 2, wherein the control element is provided at predetermined intervals non-continuously along the periphery of the nozzle opening, with exposure to the nozzle opening.

4. The liquid ejecting head according to claim 1, wherein the liquid contains a composite that has surface activity.

5. The liquid ejecting head according to claim 1, further comprising:

a plurality of head units each of which includes the nozzle, the pressure compartment, the drive element, and the control element.

6. The liquid ejecting head according to claim 1, wherein the control element is a heat generation element that applies thermal energy to the liquid in the flow passage from the pressure compartment to the nozzle opening or a vibration element that applies vibration energy to the liquid in the flow passage from the pressure compartment to the nozzle opening.

7. A liquid ejecting apparatus, comprising:

a nozzle that has a nozzle opening from which liquid is ejected;

a pressure compartment that is in communication with the nozzle;

a drive element configured to vary pressure of the liquid inside the pressure compartment for ejecting the liquid from the nozzle opening; and a control element configured to apply energy to the liquid in a flow passage from the pressure compartment to the nozzle opening, wherein the drive element is a piezoelectric drive element that is configured to receive a first driving pulse configured to cause the piezoelectric drive element to vary the pressure inside the pressure compartment, the first driving pulse being further configured to function in conjunction with a second driving pulse that is configured to cause the control element to apply the energy to the liquid in the flow passage such that the control element makes surface tension of a part of the liquid forced out from the nozzle opening by driving the drive element with the first driving pulse different from surface tension of other part of the liquid.

8. The liquid ejecting apparatus according to claim 7, wherein the control element is provided at periphery of the nozzle.

9. The liquid ejecting apparatus according to claim 8, wherein the control element is provided at predetermined intervals non-continuously along the periphery of the nozzle opening, with exposure to the nozzle opening.

10. The liquid ejecting apparatus according to claim 7, wherein the liquid contains a composite that has surface activity.

11. The liquid ejecting apparatus according to claim 7, further comprising:

a signal generation circuit that generates a drive pulse for driving the drive element and a control pulse regarding control of the control element;

wherein the control pulse is generated within a period from after a timing signal defining generation timing of the drive pulse to an end of the drive pulse.

12. The liquid ejecting apparatus according to claim 7, wherein the control element is a heat generation element that applies thermal energy to the liquid in the flow passage from the pressure compartment to the nozzle opening or a vibration element that applies vibration energy to the liquid in the flow passage from the pressure compartment to the nozzle opening.

13. A method for controlling a liquid ejecting head that includes a nozzle that has a nozzle opening from which liquid is ejected, a pressure compartment that is in communication with the nozzle, a drive element that varies pressure of the liquid inside the pressure compartment for ejecting the liquid from the nozzle opening; and a control element that applies energy to the liquid in a flow passage from the pressure compartment to the nozzle opening, comprising:

applying the energy to the liquid in the flow passage by the control element, in ejecting the liquid from the nozzle opening by driving the drive element, wherein the drive element is a piezoelectric drive element that is configured to receive a first driving pulse configured to cause the piezoelectric drive element to vary the pressure inside the pressure compartment, the first driving pulse being further configured to function in conjunction with a second driving pulse that is configured to cause the control element to apply the energy to the liquid in the flow passage such that the control element makes surface tension of a part of the liquid forced out from the nozzle opening by driving the drive element with the first driving pulse different from surface tension of other part of the liquid.

14. The method for controlling the liquid ejecting head according to claim 13, wherein, in the applying the energy, surface tension of a part of the liquid forced out from the nozzle opening in the ejecting is made different from surface tension of other part of the liquid.

15. A method for controlling a liquid ejecting apparatus that includes a nozzle that has a nozzle opening from which liquid is ejected, a pressure compartment that is in communication with the nozzle, a drive element that varies pressure of the liquid inside the pressure compartment for ejecting the liquid from the nozzle opening; and a control element that applies energy to the liquid in a flow passage from the pressure compartment to the nozzle opening, comprising:

applying the energy to the liquid in the flow passage by the control element, in ejecting the liquid from the nozzle opening by driving the drive element, wherein the drive element is a piezoelectric drive element that is configured to receive a first driving pulse configured to cause the piezoelectric drive element to vary the pressure inside the pressure compartment, the first driving pulse being further configured to function in conjunction with a second driving pulse that is configured to cause the control element to apply the energy to the liquid in the flow passage such that the control element makes surface tension of a part of the liquid forced out from the nozzle opening by driving the drive element with the first driving pulse different from surface tension of other part of the liquid.

16. The method for controlling the liquid ejecting apparatus according to claim 15, wherein, in the applying the energy, surface tension of a part of the liquid forced out from the nozzle opening in the ejecting is made different from surface tension of other part of the liquid.

* * * * *